US009902523B2

(12) United States Patent
Baltz et al.

(10) Patent No.: US 9,902,523 B2
(45) Date of Patent: Feb. 27, 2018

(54) BAKERY TRAY

(71) Applicant: Rehrig Pacific Company, Los Angeles, CA (US)

(72) Inventors: Kyle L. Baltz, Rossmoor, CA (US); John Paul Kapla, Tomball, TX (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/319,712

(22) Filed: Jun. 30, 2014

(65) Prior Publication Data

US 2015/0076028 A1 Mar. 19, 2015

Related U.S. Application Data

(62) Division of application No. 13/359,542, filed on Jan. 27, 2012, now Pat. No. 8,763,809.

(60) Provisional application No. 61/437,326, filed on Jan. 28, 2011, provisional application No. 61/480,180, filed on Apr. 28, 2011, provisional application No. 61/566,510, filed on Dec. 2, 2011.

(51) Int. Cl.

| | |
|---|---|
| ***B65D 1/34*** | (2006.01) |
| ***B65D 21/02*** | (2006.01) |
| ***B65D 71/70*** | (2006.01) |
| ***B65D 21/04*** | (2006.01) |

(52) U.S. Cl.

CPC ..... *B65D 1/34* (2013.01); *B65D 21/0212* (2013.01); *B65D 21/0216* (2013.01); *B65D 21/0233* (2013.01); *B65D 21/0237* (2013.01); *B65D 21/045* (2013.01); *B65D 71/70* (2013.01)

(58) Field of Classification Search

CPC .. B65D 21/045; B65D 21/0212; B65D 71/70; B65D 21/0216; B65D 21/0233; B65D 21/0237

USPC ..... 206/503, 507

See application file for complete search history.

(56) References Cited

U.S. PATENT DOCUMENTS

| | | | |
|---|---|---|---|
| 1,542,115 | A | 6/1925 | Weis |
| 1,720,947 | A | 7/1929 | Duggan |
| 2,232,632 | A | 2/1941 | Reynolds |
| 2,896,835 | A | 7/1959 | Burkhardt et al. |

(Continued)

FOREIGN PATENT DOCUMENTS

| | | | |
|---|---|---|---|
| DE | 102010013284 | A1 | 9/2011 |
| JP | 07187269 | A | 7/1995 |

*Primary Examiner* — Jeffrey Allen
*Assistant Examiner* — Jennifer Castriotta
(74) *Attorney, Agent, or Firm* — Carlson, Gaskey & Olds PC

(57) ABSTRACT

A tray includes a base and a plurality of walls extending upward from the base. In one feature, a first wall of the plurality of walls may include a projection outward from the first wall. The projection is aligned with an upper edge of the first wall, such that the projection is outward of a portion of the upper edge of the first wall. The projection of an identical upper tray stacked on the tray would interlock with the upper edge of the first wall to resist outward deflection of the upper edge of the first wall of the tray. In another feature, a platform may extend inward from at least one of the walls to support smaller trays stacked thereon. In another feature, an exterior of each of the side walls may include an interlocking recess for receiving automated handling equipment for supporting the tray.

26 Claims, 42 Drawing Sheets

(56) References Cited

U.S. PATENT DOCUMENTS

| | | | | | |
|---|---|---|---|---|---|
| 3,182,856 | A | | 5/1965 | Goltz | |
| 3,401,828 | A | | 9/1968 | Bockenstette | |
| 5,035,326 | A | * | 7/1991 | Stahl | 206/507 |
| 5,249,699 | A | | 10/1993 | Williams | |
| 5,287,966 | A | * | 2/1994 | Stahl | 206/509 |
| 5,344,022 | A | * | 9/1994 | Stahl | B65D 21/041 206/505 |
| 5,494,163 | A | * | 2/1996 | Apps | B65D 21/062 206/506 |
| 5,588,549 | A | | 12/1996 | Furtner et al. | |
| D382,404 | S | | 8/1997 | Cope | |
| 5,671,857 | A | | 9/1997 | Stromberg | |
| 6,273,006 | B1 | | 8/2001 | Reutter et al. | |
| 6,273,259 | B1 | * | 8/2001 | Stahl | 206/511 |
| 6,837,377 | B2 | | 1/2005 | Shuert | |
| 7,152,752 | B2 | | 12/2006 | Kurtenbach | |
| 7,195,127 | B2 | | 3/2007 | Hsu et al. | |
| D553,860 | S | * | 10/2007 | Fernandez | D3/307 |
| 8,191,910 | B2 | | 6/2012 | Landau et al. | |
| 8,695,795 | B1 | | 4/2014 | Huber | |
| 2005/0183980 | A1 | * | 8/2005 | Fernandez et al. | 206/509 |
| 2013/0008814 | A1 | | 1/2013 | Ritzberger et al. | |
| 2013/0200915 | A1 | | 8/2013 | Panagas | |

* cited by examiner

BAKERY TRAY

This application is a divisional of U.S. Ser. No. 13/359,542, now U.S. Pat. No. 8,763,809, which claims priority to U.S. Provisional Application Ser. Nos. 61/437,326, filed Jan. 28, 2011, 61/480,180, filed Apr. 28, 2011 and 61/566,510, filed Dec. 2, 2011.

BACKGROUND

Bakery trays typically include a base from which front, rear and side walls extend upward. The side walls may include feet that are arranged relative to recesses at upper edges of the side walls such that the tray can stack with an identical tray at a first orientation and nest (or stack at a different height) with the identical tray at a second orientation, where the second orientation is 180° relative to the first orientation.

When many of these trays are stacked or nested, a substantial portion of the weight from each tray and the trays above it is transferred to the tray below via the feet. However, for the bottom tray on the floor, the feet may not contact the floor. Rather, the bottom tray is supported on drag rails, which are inward of the feet. Thus, the weight of all the trays above the bottom tray bears on the bottom tray at points outward of the drag rails, which may cause the side walls of the bottom tray to twist outward.

SUMMARY

A tray having one feature disclosed herein includes a base and a plurality of walls extending upward from the base. A first wall of the plurality of walls includes a projection outward from the first wall. The projection is aligned with an upper edge of the first wall, such that the projection is outward of a portion of the upper edge of the first wall. In this manner, the projection of an identical upper tray stacked on the tray would interlock with the upper edge of the first wall to resist outward deflection of the upper edge of the first wall of the tray.

In one embodiment disclosed herein, the projection has a T-shaped cross-section, complementary to a T-shaped recess in the upper edge of the first wall.

A tray having another feature disclosed herein includes a base and a plurality of walls extending upward from the base. A platform extends inwardly from at least one of the walls. The platform can be used to support smaller trays stacked thereon. For example, trays that are approximately half the size of the tray can be supported on three of the walls and the platform. In the embodiment disclosed herein as one example, platforms extend inwardly from an opposing pair of the walls to support the half-size trays.

In a tray having another feature disclosed herein, a base includes front and rear walls extending upward from front and rear edges of the base. Side walls extend upward from side edges of the base. Each of the side walls includes at least one interlocking recess for receiving automated handling equipment for supporting the tray.

In one specific example disclosed herein, each interlocking recess is defined by a curved upper wall protruding outwardly from the side wall.

DETAILED DESCRIPTION OF THE PREFERRED EMBODIMENT

Figure 1:
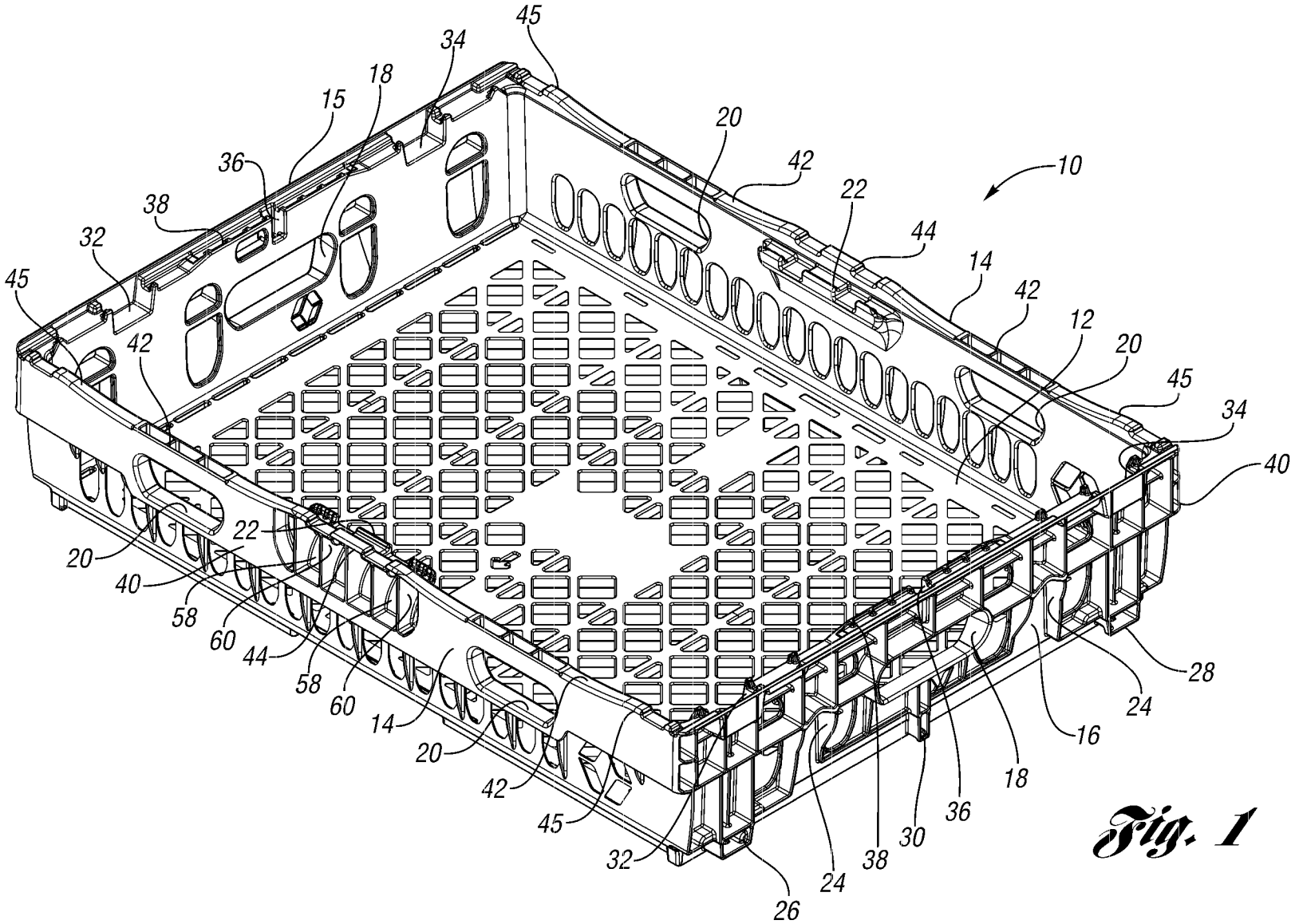
FIG. 1 is a perspective view of tray according to a first embodiment.

A bakery tray 10 according to one embodiment of the present invention is shown in FIG. 1. The bakery tray 10 generally includes a base 12, front and rear walls 14 extending upwardly from front and rear edges of the tray 10, and side walls 15, 16 extending upwardly from side edges of the base 12. The side walls 15, 16 include handles 18 formed therein. Each of the front and rear walls 14 includes a pair of handles 20 formed therein. Each of the front and rear walls 14 includes a platform 22 projecting inwardly adjacent an upper edge thereof and centered between the handles 20. The platform 22 is generally hollow with openings 58 to the exterior of the tray 10 between ribs 60.

Each of the side walls 15, 16 includes a pair of interlocking recesses 24 for interlocking with automated handling equipment. Each side walls 15, 16 further includes a rear foot 26, front foot 28, and center projection 30 projecting downwardly. The front foot 28 is adjacent the front edge of the tray 10 while the rear foot 26 is spaced away from the rear edge of the tray 10. An upper edge of each side wall 15, 16 includes a rear recess 32 aligned with the rear foot 26, a front recess 34 aligned with the front foot 28 and a center recess 36 aligned with the center projection 30. An inner rail 38 extends across portions of the side walls 15, 16. The front and rear walls 14 include a double-walled lip portion 40 that projects outwardly relative to a lower portion of the front and rear walls 14. The upper edge of the front and rear walls 14 each include a raised central portion 44 adjacent the platform, a recessed portion 42 between the raised central portion 44 and each side wall 15, 16, and an outer raised portion 45 adjacent each side wall 15, 16.

Figure 2A:
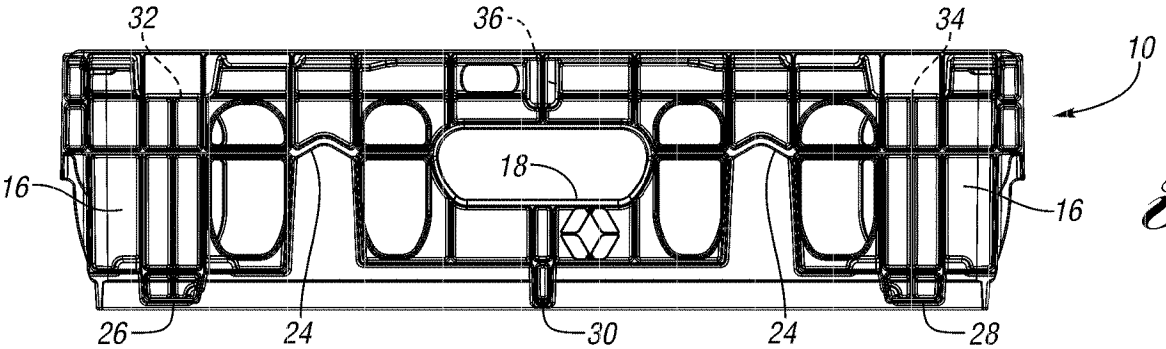
FIGS. 2A and 2B are side views of the tray.
Figure 2B:
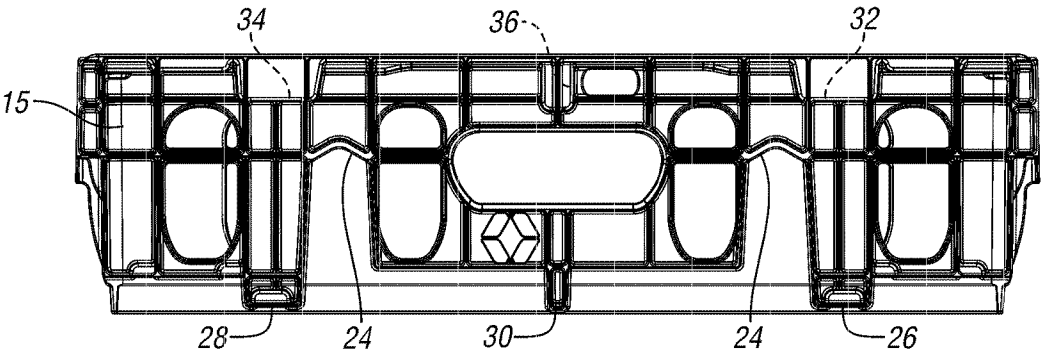

FIGS. 2A and 2B show the two sides of the tray 10. FIG. 2A shows the same side wall 16 as FIG. 1. FIG. 2B shows the opposite side wall 15. As shown in FIG. 2A, on side wall 16, the feet 26, 28 are spaced further outward (toward front and rear walls 14), while in FIG. 2B, on side wall 15, the feet 26, 28 are spaced further inward (away from front and rear walls 14). This is one way of providing stacking at a high stack position in one orientation and at a low stack position (or alternatively, nesting) in another (180 degree) orientation.

Figure 3:
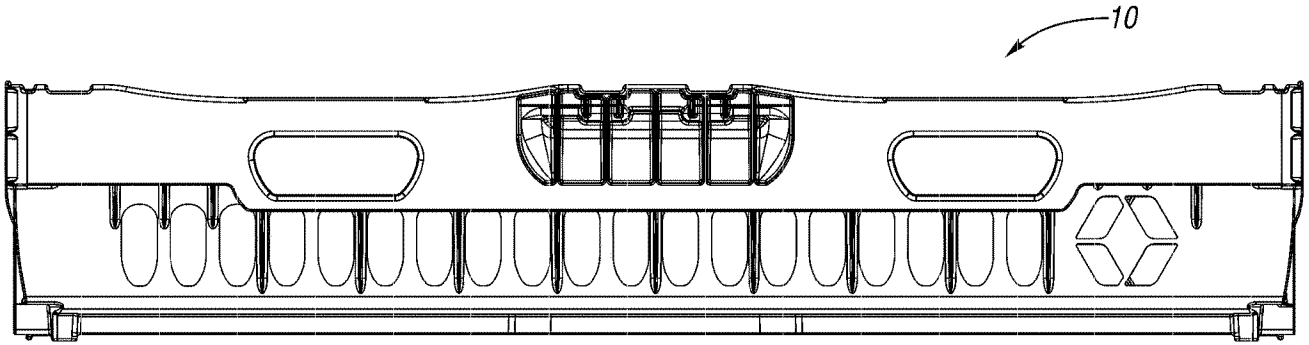
FIG. 3 is a front view of the tray.

FIG. 3 is a front view of the tray 10.

Figure 4:
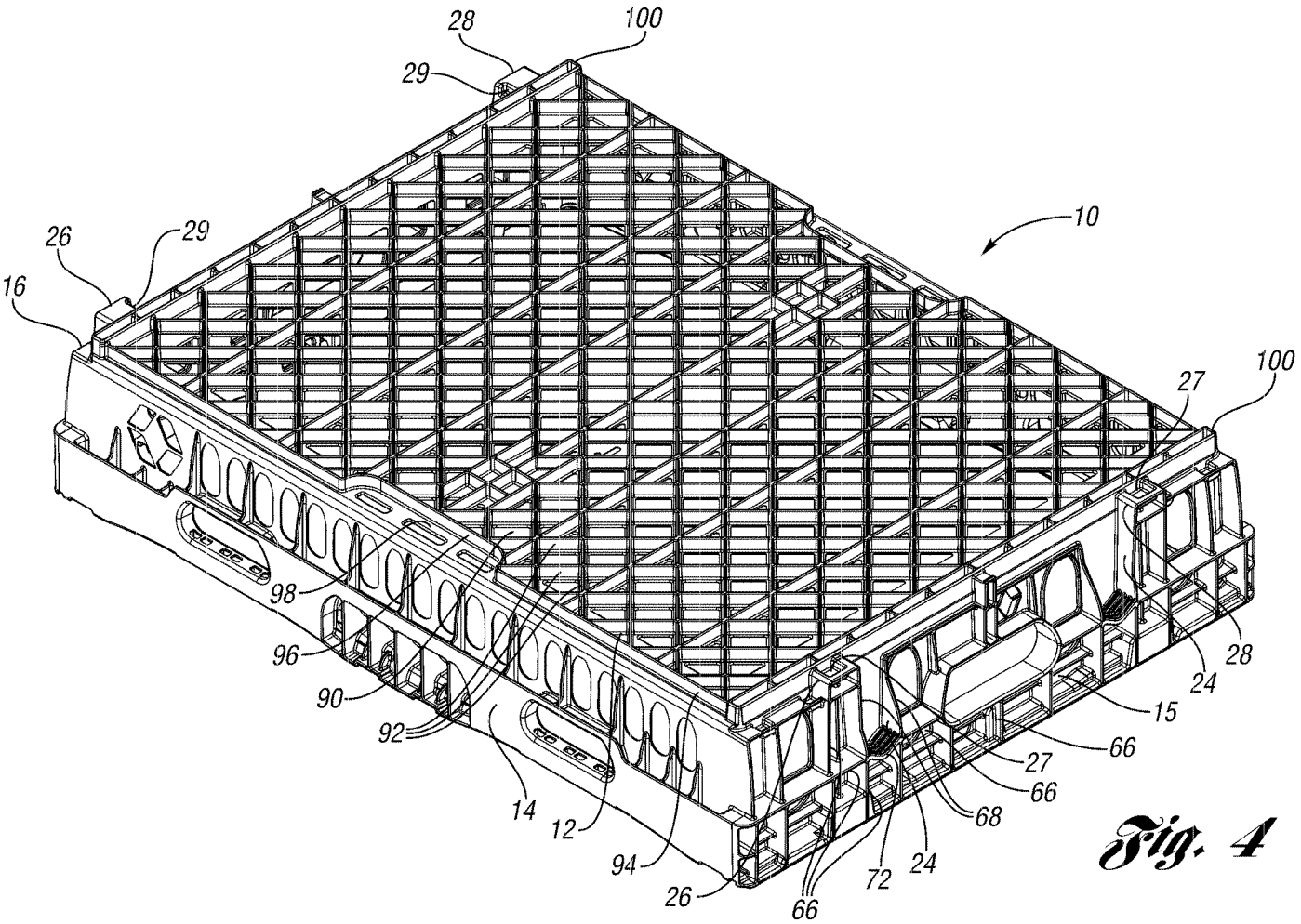
FIG. 4 is bottom perspective view of the tray.

FIG. 4 is a bottom perspective view of the tray 10. The base 12 includes a upper, planar panel portion 90 with a plurality of cross-ribs 92 projecting downward therefrom, including a peripheral rib 94 extending along most of the periphery of the front and rear walls 14. Each peripheral rib 94 includes a recessed portion 96, where the peripheral rib 94 juts inwardly to expose a portion 98 of the planar panel portion 90. The exposed portion 98 of the upper planar portion 90 is aligned with the platform 22 (FIG. 1). As a result, when one tray 10 is stacked on another tray 10, the platforms 22 of the lower tray 10 will be received within the recessed portions 96 of the peripheral ribs 94 of the upper tray 10 and the ribs 92, 94 will not impact the platforms 22 and prevent proper stacking of the trays 10. Drag rails 100 extend downward from the base 12 inward of each side wall 15, 16. The drag rails 100 may be double-walled drag rails 100 with cross-ribs, as shown. The bottom surface of the feet 26, 28 on the side wall 15 each include a central recess 27, while the feet 26, 28 on the side wall 16 each include a lateral recess 29, such that the lateral recesses 29 are open laterally facing one another.

FIG. 4 also shows the interlocking recesses 24. Each side wall 15, 16 includes a plurality of ribs 66 extending outwardly of a planar wall portion. Ribs 68 partially define the interlocking recess 24. The ribs 68 form an upper curved wall and two generally vertical walls. A plurality of vertical ribs 72 extend downward from the upper curved wall to increase the strength and rigidity of the upper curved wall and to provide more gripping with the automated handling equipment.

Figure 5:
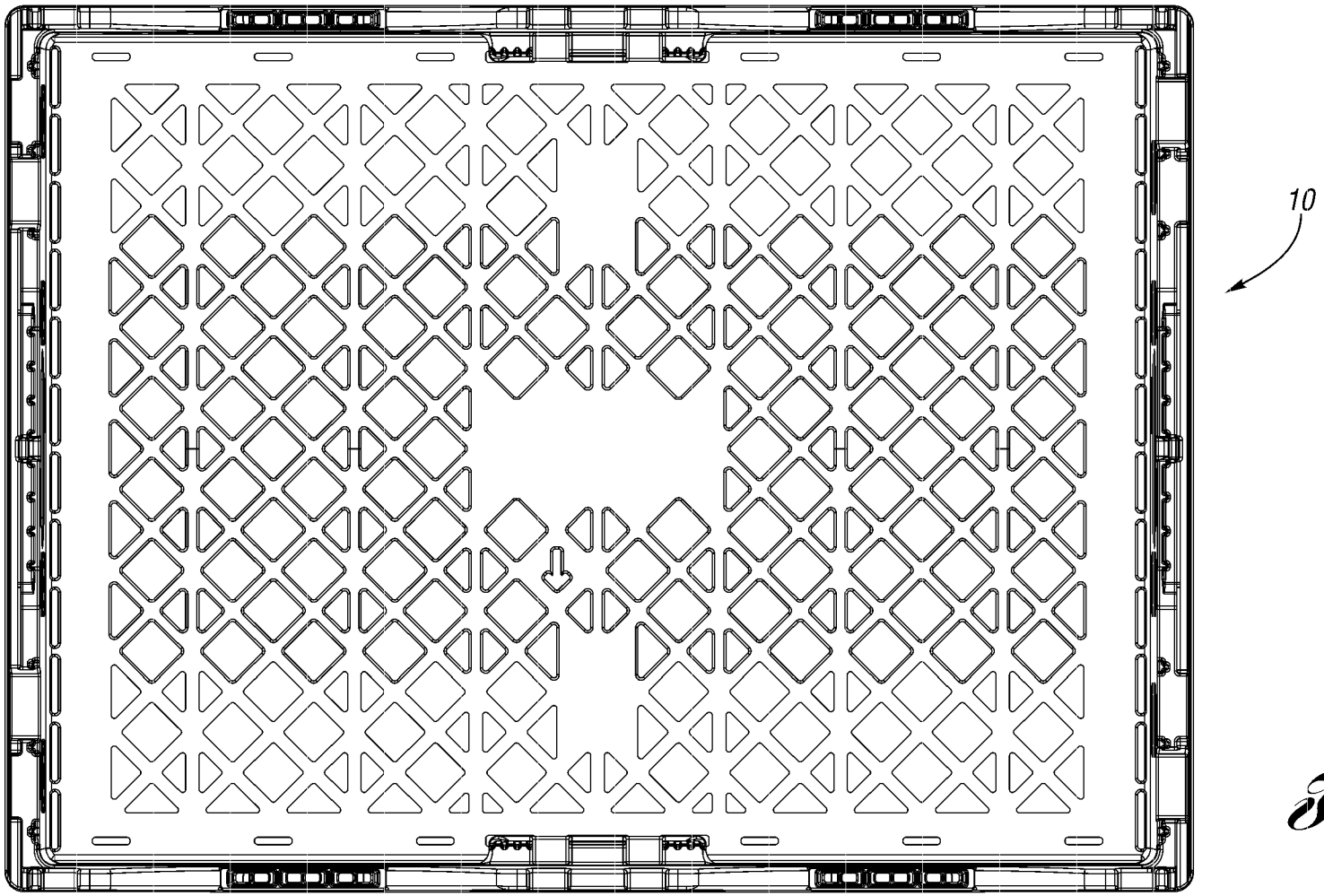
FIG. 5 is a top view of the tray.

FIG. 5 is a top view of the tray 10.

Figure 6:
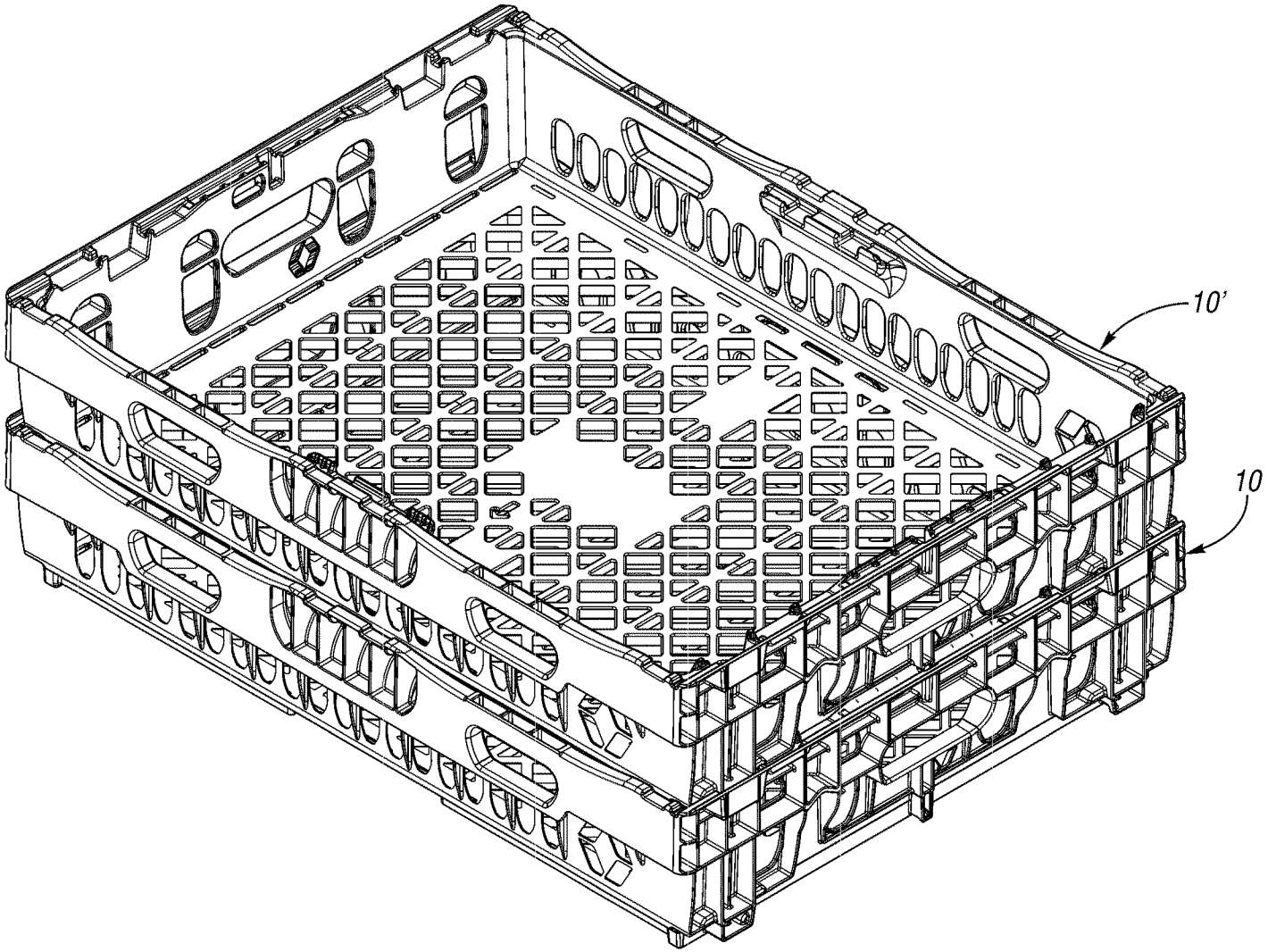
FIG. 6 is a perspective view of the tray with an identical tray stacked thereon in a low stack position.
Figure 7:
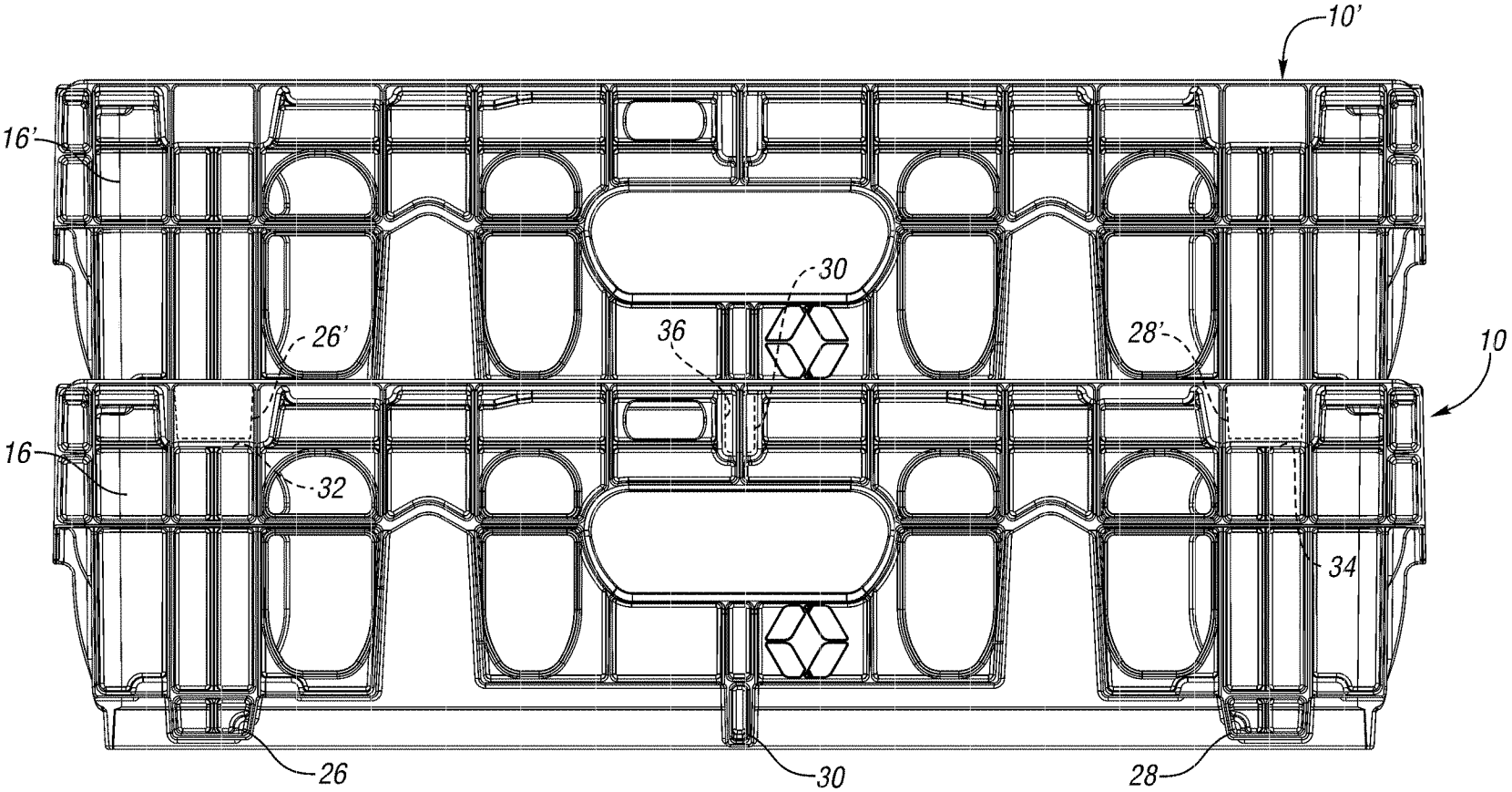
FIG. 7 is a side view of the trays of FIG. 6.

FIGS. 6-7 show the tray 10 with a similar tray 10' stacked thereon in a low stack position, i.e., in a similar orientation with the front feet 28' received in the front recesses 34 and the rear feet 26' received in the rear recesses 32. The center projections 30' are received in the center recesses 36.

Figure 8:
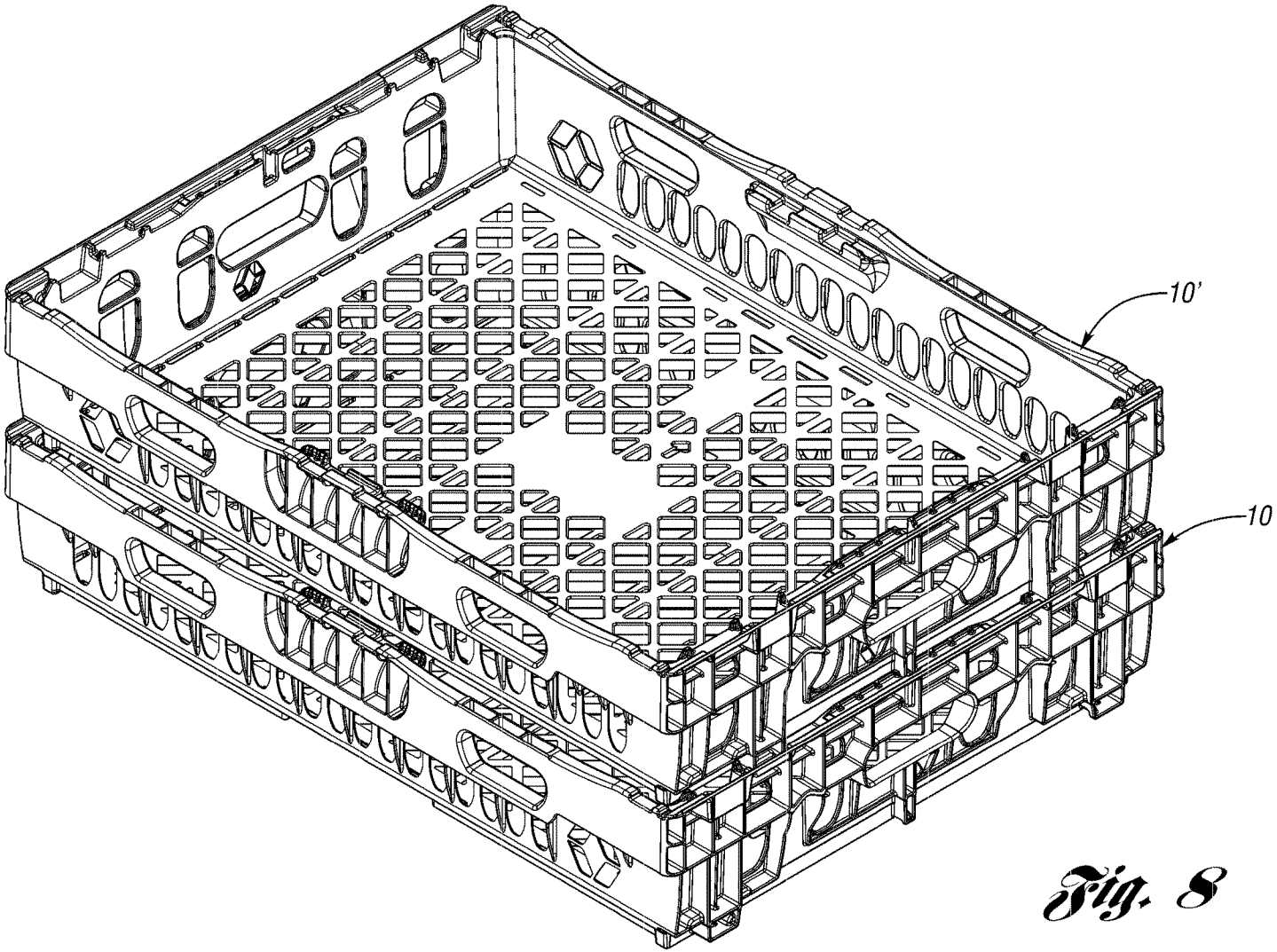
FIG. 8 is a perspective view of the trays of FIG. 6 in a high stacked position.
Figure 9:
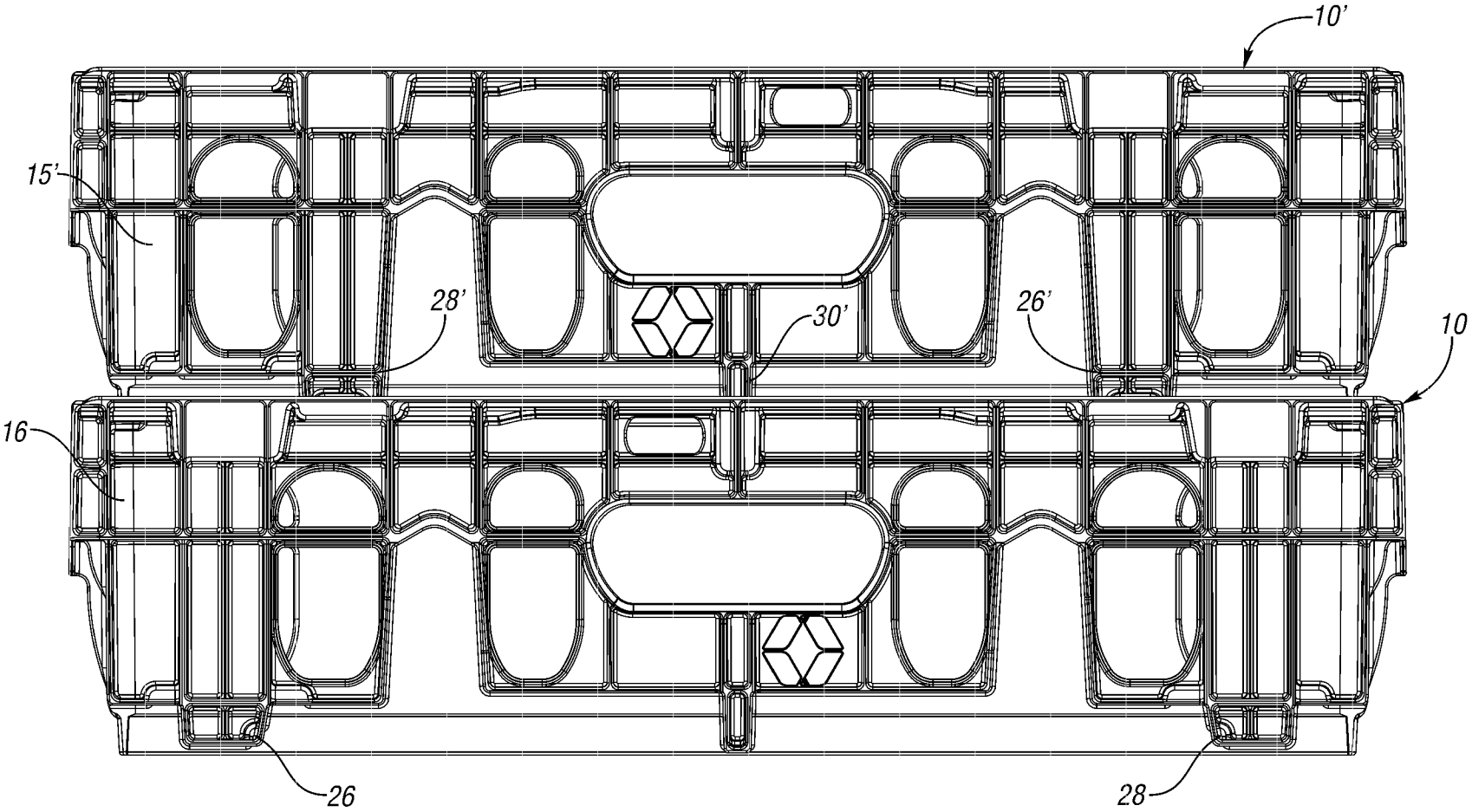
FIG. 9 is a side view of the trays of FIG. 8.

In FIGS. 8-9, the upper tray 10' is rotated 180° and is stacked on the lower tray 10 in a high stack position, i.e., with the rear feet 26' stacked on the upper edge of the side walls 16 and the front feet 28' stacked on the upper edge of the side walls 16, not received in the recesses 32, 34. In the high stack position, larger goods or more layers of goods can be placed in the lower tray 10.

Figure 10:
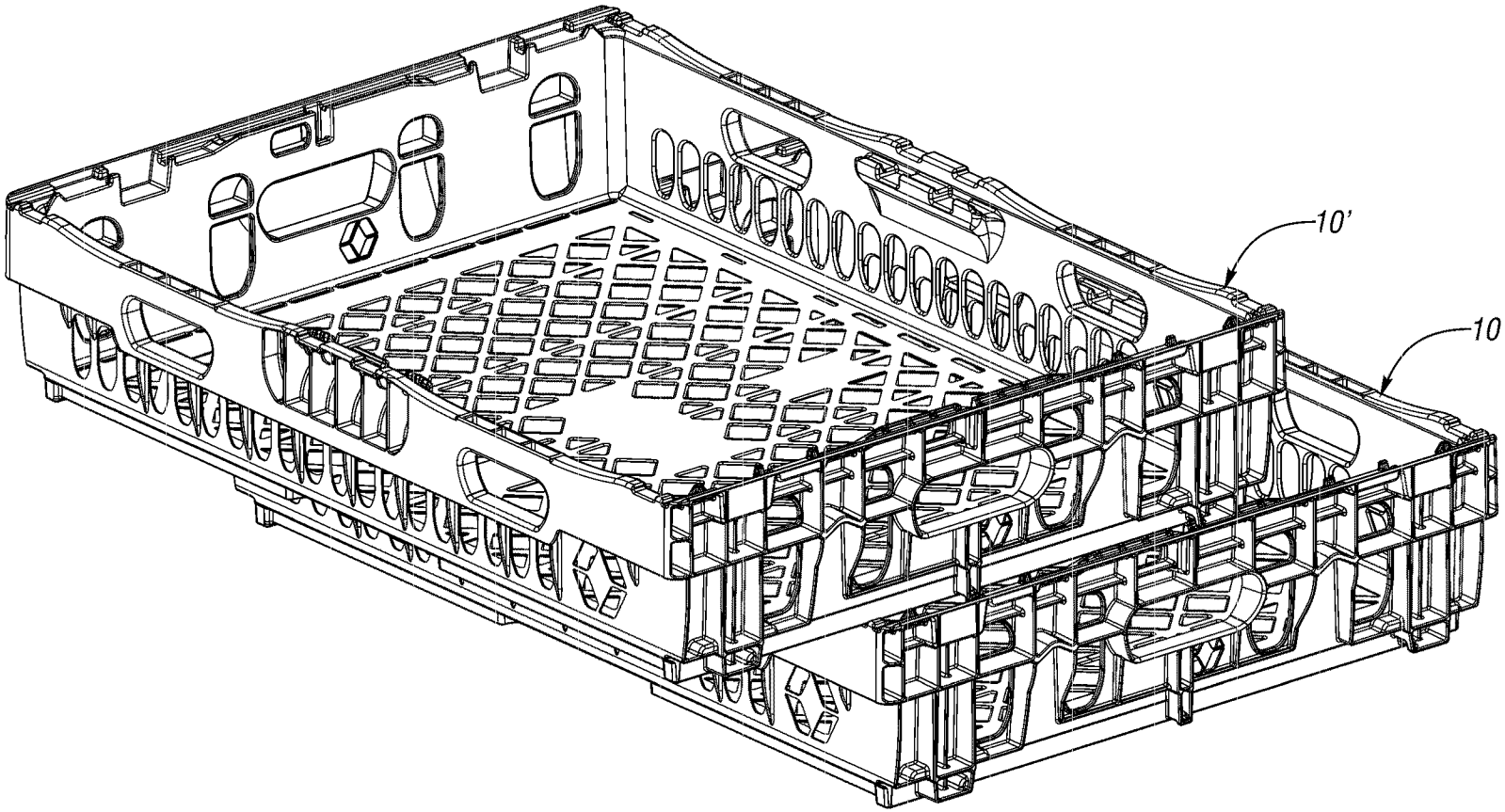
FIG. 10 is a perspective view of the tray with an identical tray being slide-stacked onto the tray.
Figure 11:
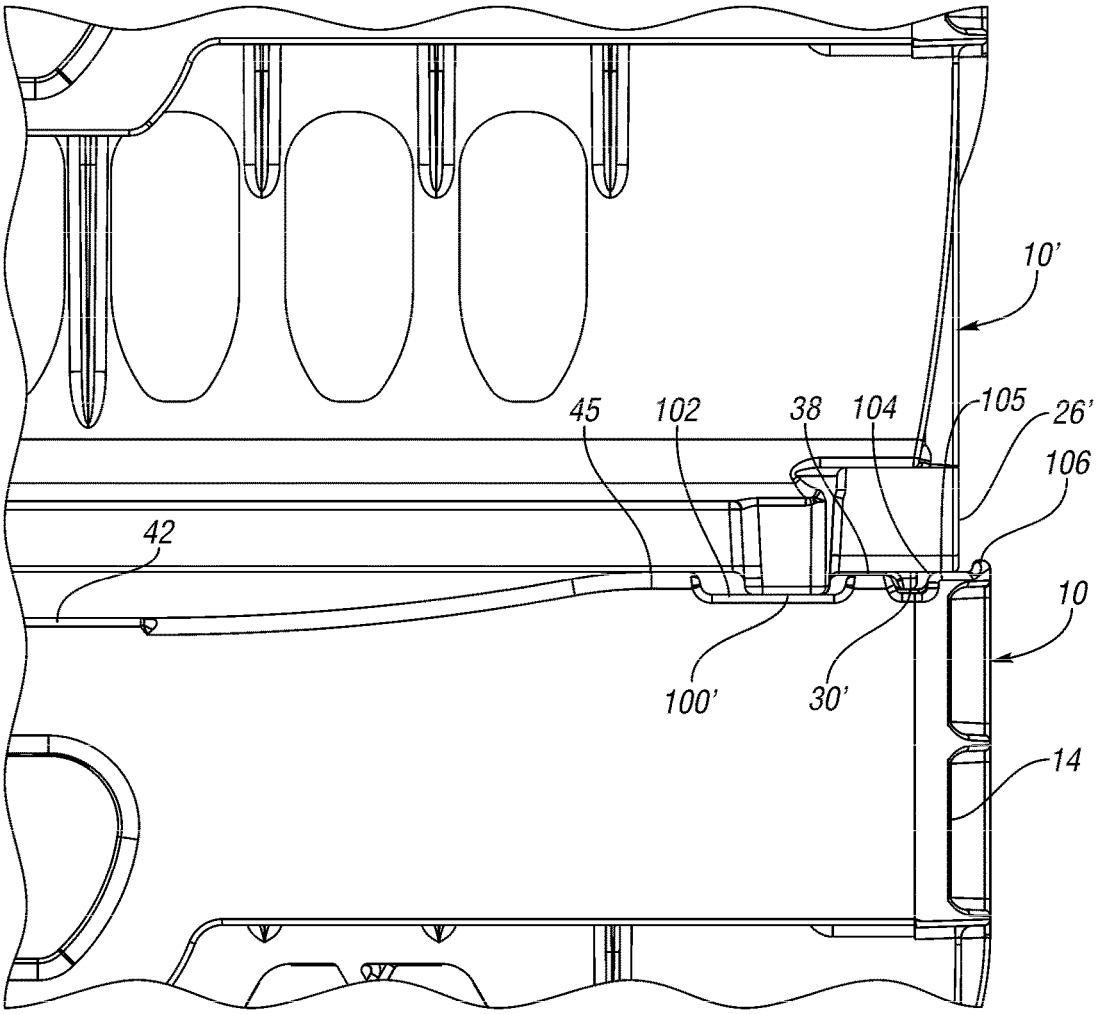
FIG. 11 is an enlarged front view a portion of the trays of FIG. 10.

FIGS. 10-11 illustrate the upper tray 10' as it is being slide-stacked onto the lower tray 10. Referring to FIG. 11, the upper edge of the front and rear walls 14 (front and rear walls 14 are symmetric about longitudinal and lateral axes in this embodiment) is shown in more detail. The upper edge of the front and rear walls 14 each includes the recessed portion 42 and an outer raised portion 45. A notch 102 is formed in the outer raised portion 45 to accommodate the drag rail 100' of the upper tray 10'. The feet 26' of the upper tray 10' rest on the inner rail 38 of the lower tray 10 and an upper surface 105 of the side wall 16. A downward projection from the central projection 30' of the upper tray 10' extends into an outer notch 104 in the upper edge of the bottom tray 10. An outer rail 106 projects upwardly from the side wall 16 outward of the upper tray 10'.

Figure 12:
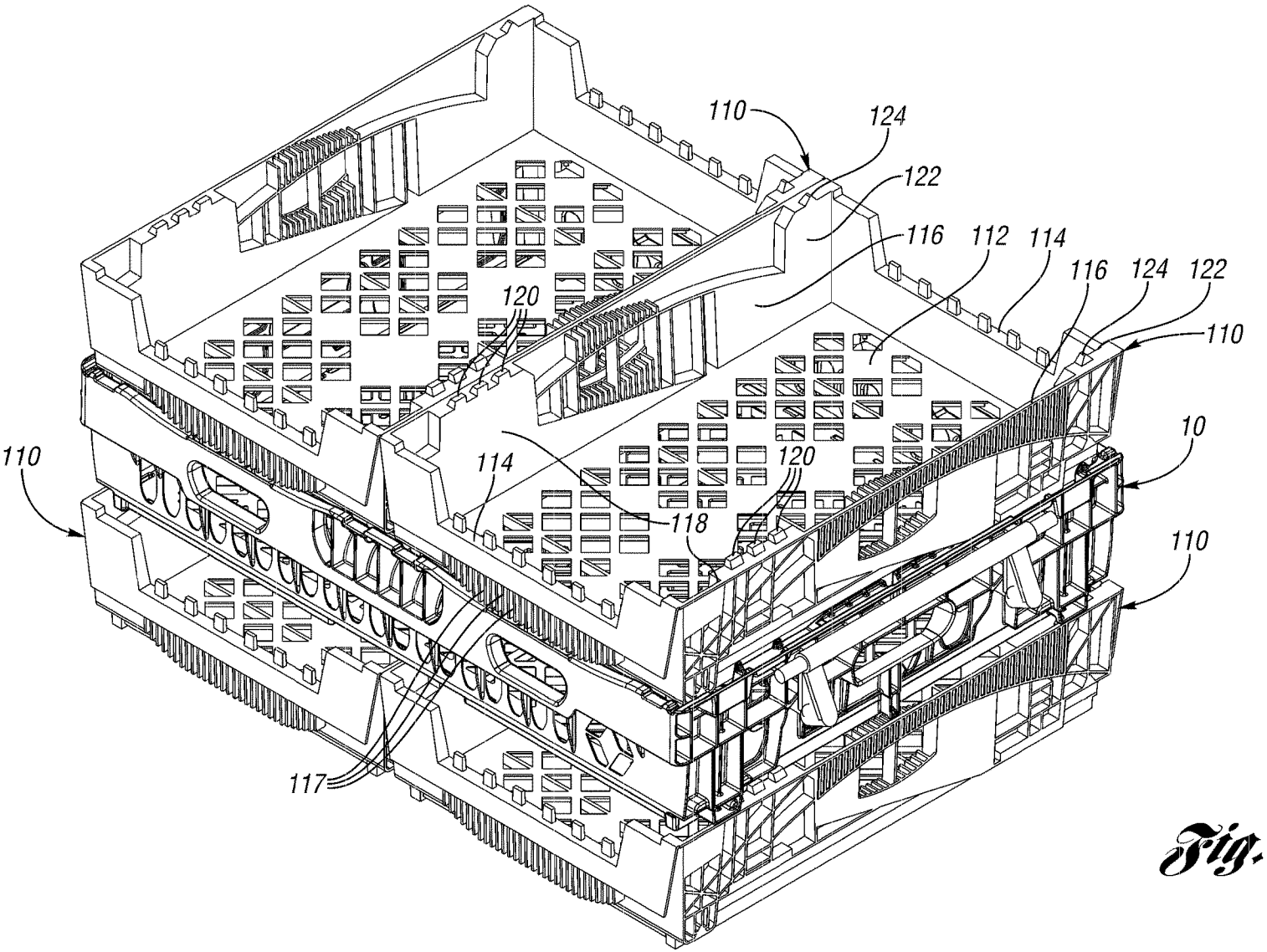
FIG. 12 is a perspective view of the tray stacked onto smaller prior art trays and having two prior art trays stacked thereon.

As shown in FIG. 12, the tray 10 can support thereon and be supported on two prior art trays 110 that are approximately half the size of the tray 10. The prior art tray 110 includes a base 112, front and rear walls 114 and side walls 116. The prior art tray 110 is symmetric about the long axis, i.e. the side walls 116 are mirror images of one another. The front and rear walls 114 each include a plurality of vertical ribs 117 on an exterior surface thereof. The lower ends of the ribs 117 are aligned along an arc and therefore are not sufficient for stably supporting the prior art tray 110 on the front and rear walls 14 of the tray 10. Thus, the front and rear walls 114 of the prior art tray 110 are also supported on the platforms 22.

The prior art tray 110 includes rear support columns 118 having three castellations 120 on an upper support surface thereof. Front support columns 122 each have a single castellation 124 on an upper support surface thereof.

Figure 13:
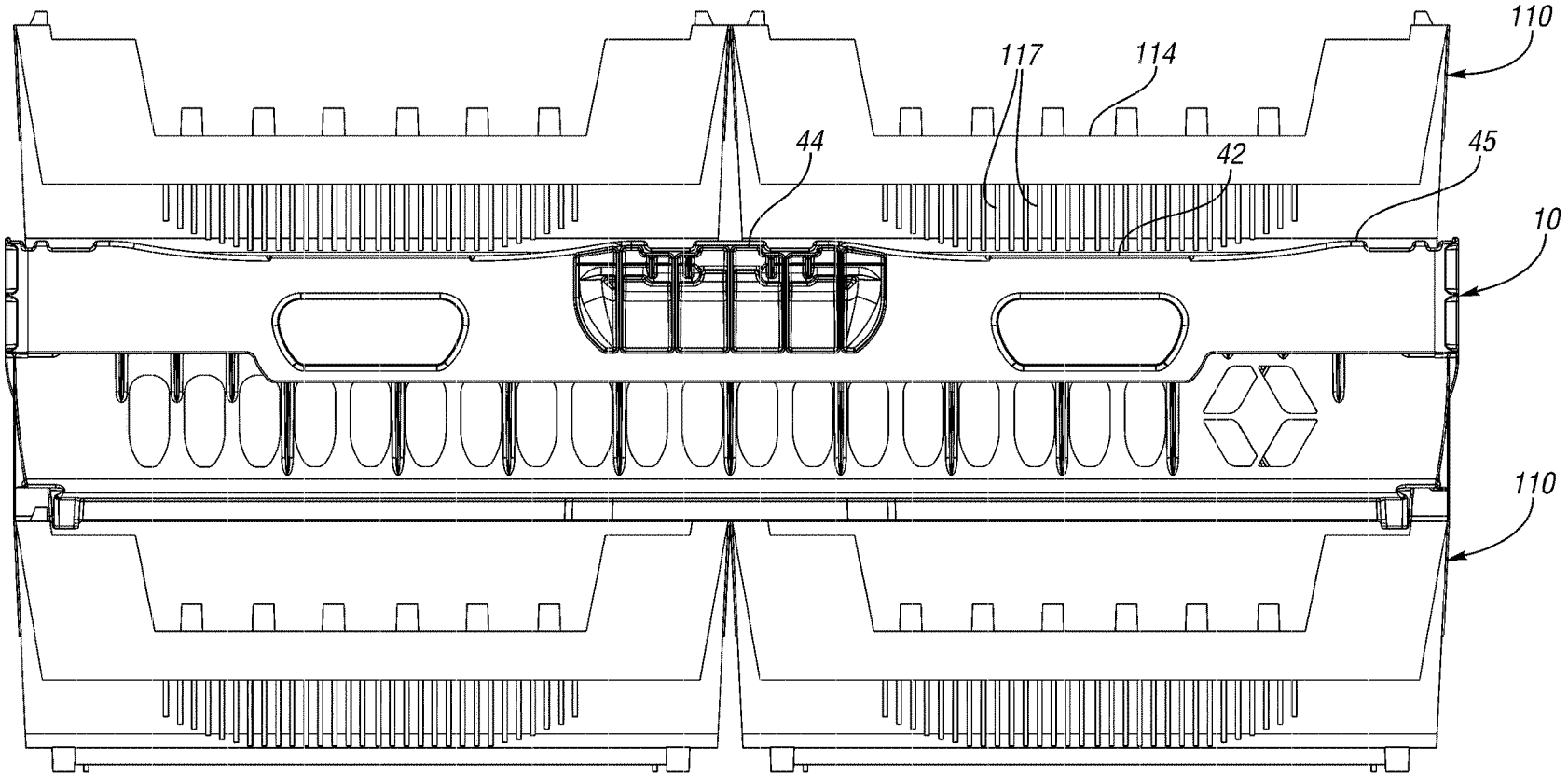
FIG. 13 is a front view of the trays of FIG. 12.

As shown in FIG. 13, the vertical ribs 117 of the prior art trays 110 align with the recessed portion 42 of the upper edge of the front and rear walls 14.

Figure 14:
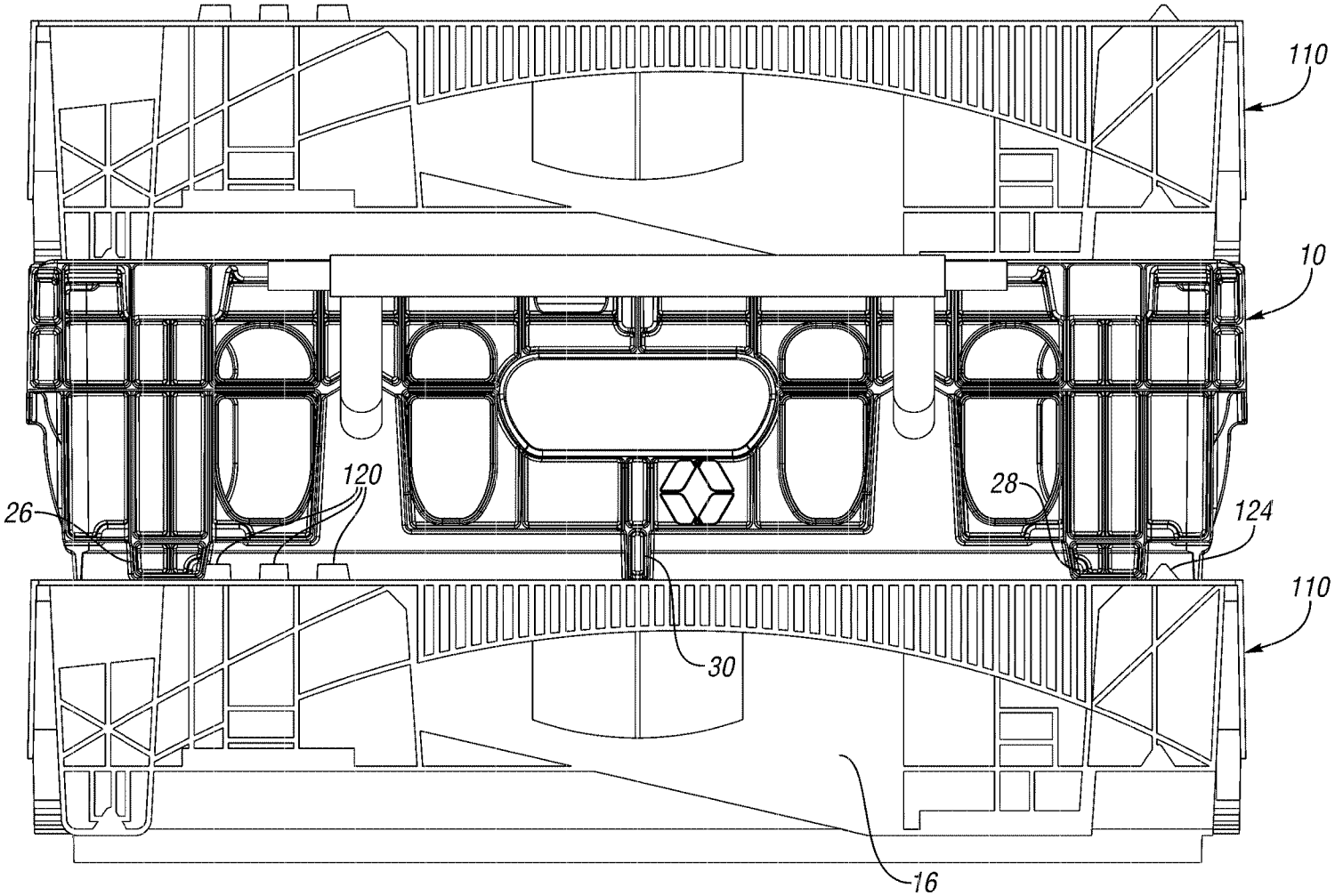
FIG. 14 is a side view of the trays of FIG. 12.

Referring to FIG. 14, the feet 26 of the tray 10 contact the upper surface of the rear support columns 118 rearward of the castellations 120. The feet 28 contact the upper surface of the front support columns 120 rearward of the castellation 124.

Figure 15:
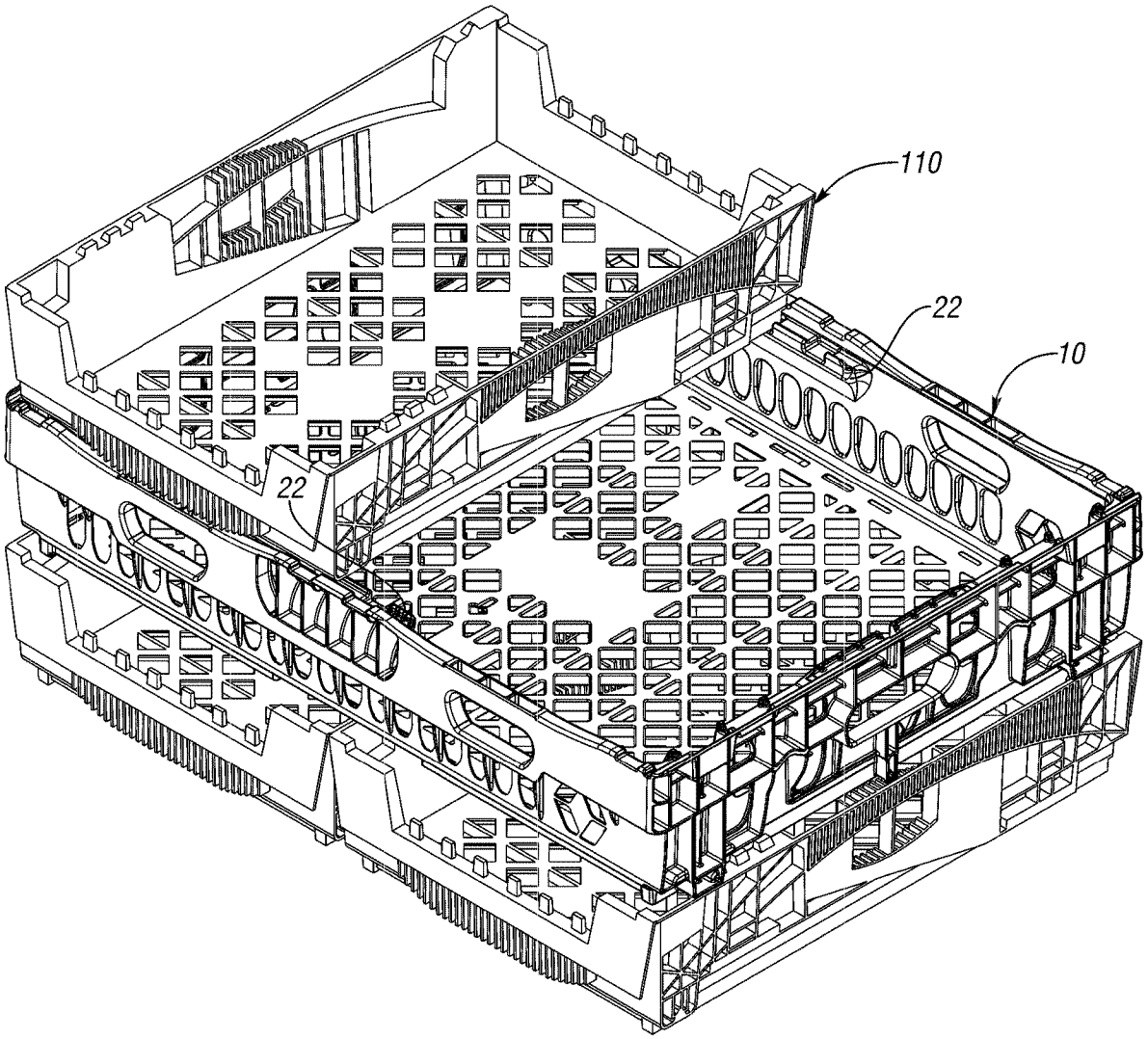
FIG. 15 shows the trays of FIG. 12 with one of the upper trays removed.
Figure 16:
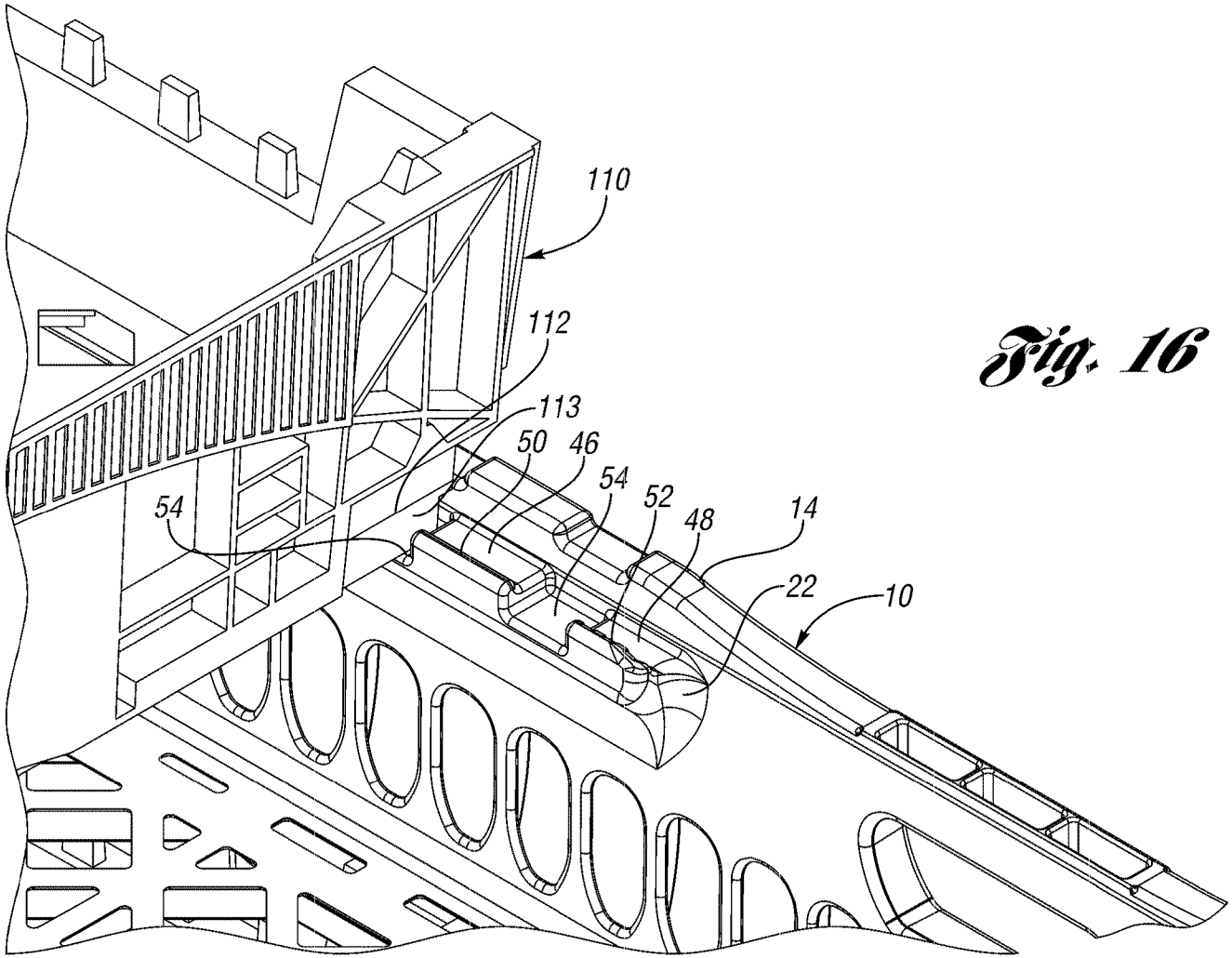
FIG. 16 is an enlarged perspective view of one of the platforms supporting the prior art tray.
Figure 17:
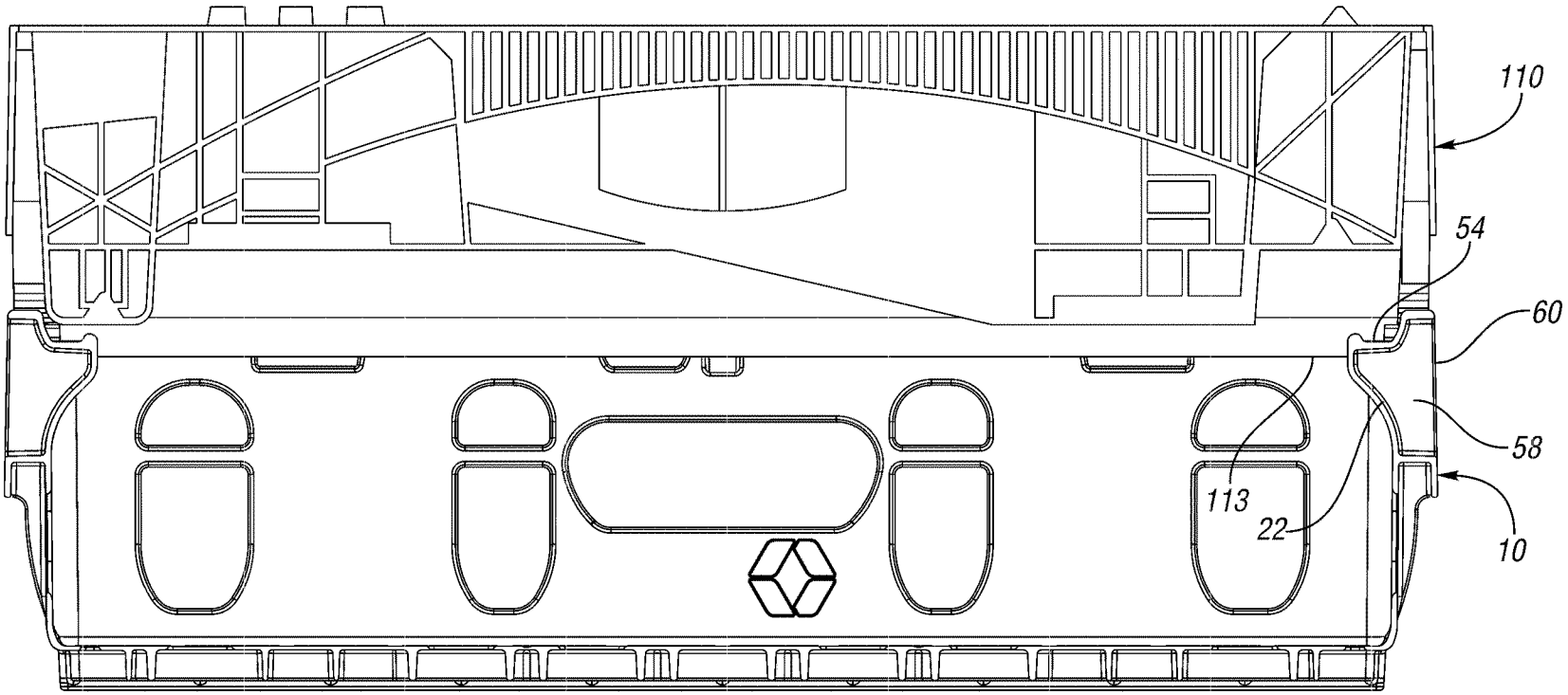
FIG. 17 is a cut-away view through the platform of FIG. 16.

FIGS. 15-17 show the trays 10, 110 of FIG. 12 with one upper prior art tray 110 removed. FIG. 16 is an enlarged view of one of the platforms 22 (the other is identical) supporting the prior art tray 110. The platform 22 extends inwardly from an inner surface of each front and rear wall 14. The platform 22 includes a central support surface 46 spaced away from outer support surfaces 48. A ridge 50 projects upwardly from an inner edge of the central support surface 46. Ridges 52 project upwardly from inner edges of the outer support surfaces 48. Lower surfaces 54 are between each outer support surface 48 and the central support surface 46. A rib 113 extending downwardly from the base 112 of the prior art tray 110 is supported on the lower surface 54 of the platform 22.

Figure 18:
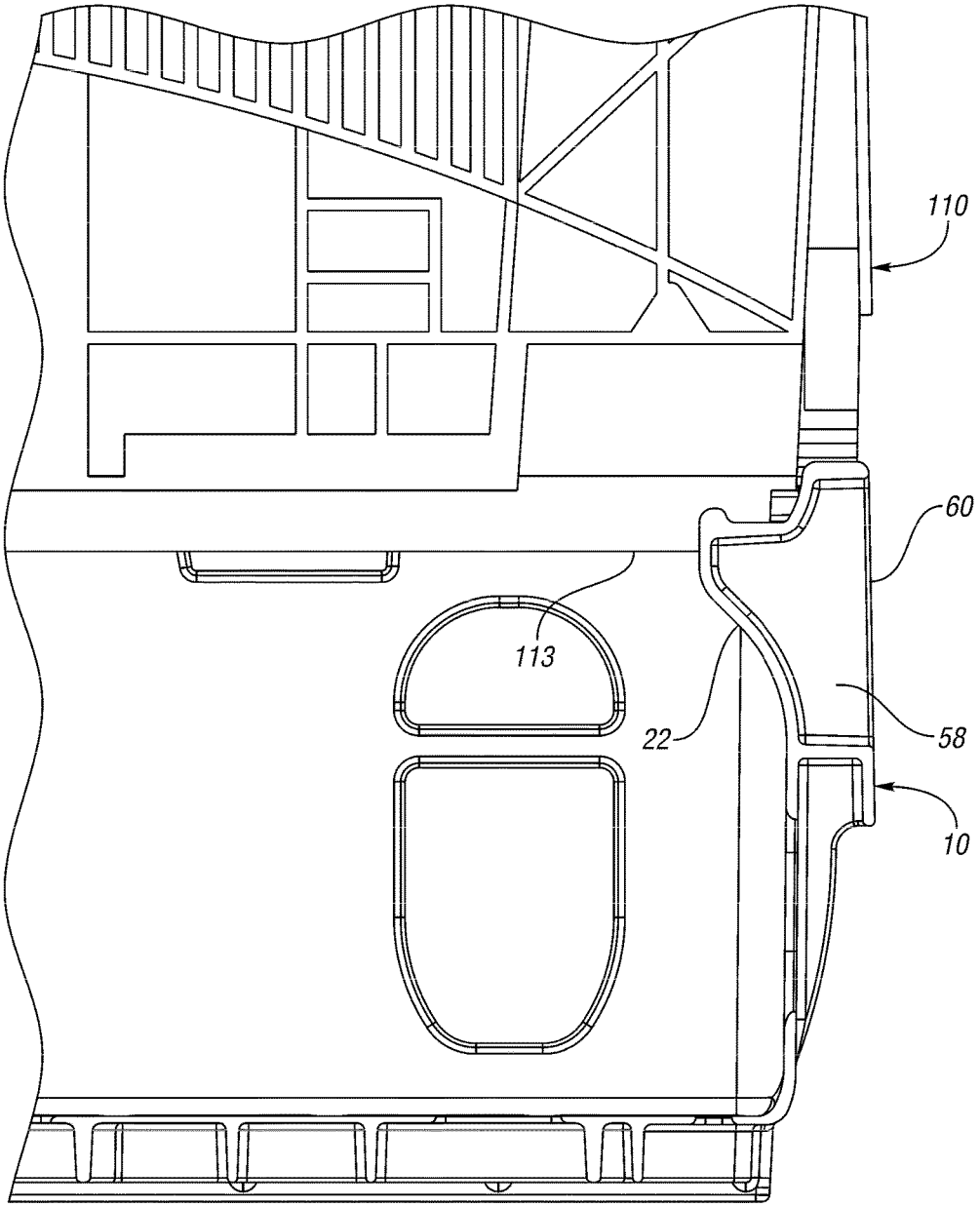
FIG. 18 is an enlarged view of the platform of FIG. 17.

FIG. 17 is a cutaway view through the platform 22 of FIG. 16. FIG. 18 is an enlarged view of the platform 22 of FIG. 17. The platform 22 is generally hollow with openings 58 to the exterior of the tray 10 adjacent ribs 60.

Figure 19:
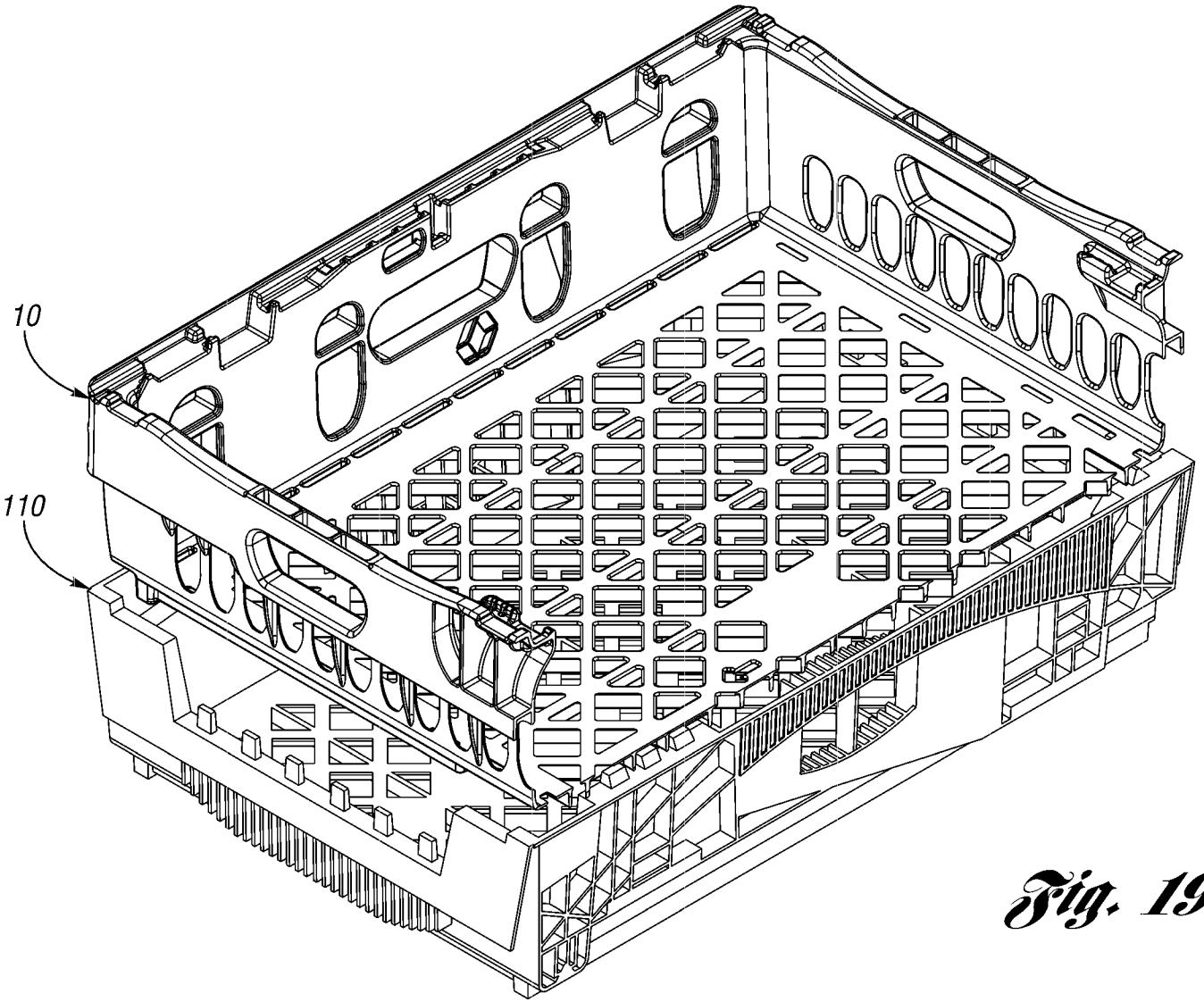
FIG. 19 is a perspective view of a halved tray (for purpose of illustration) stacked on the prior art tray.
Figure 20:
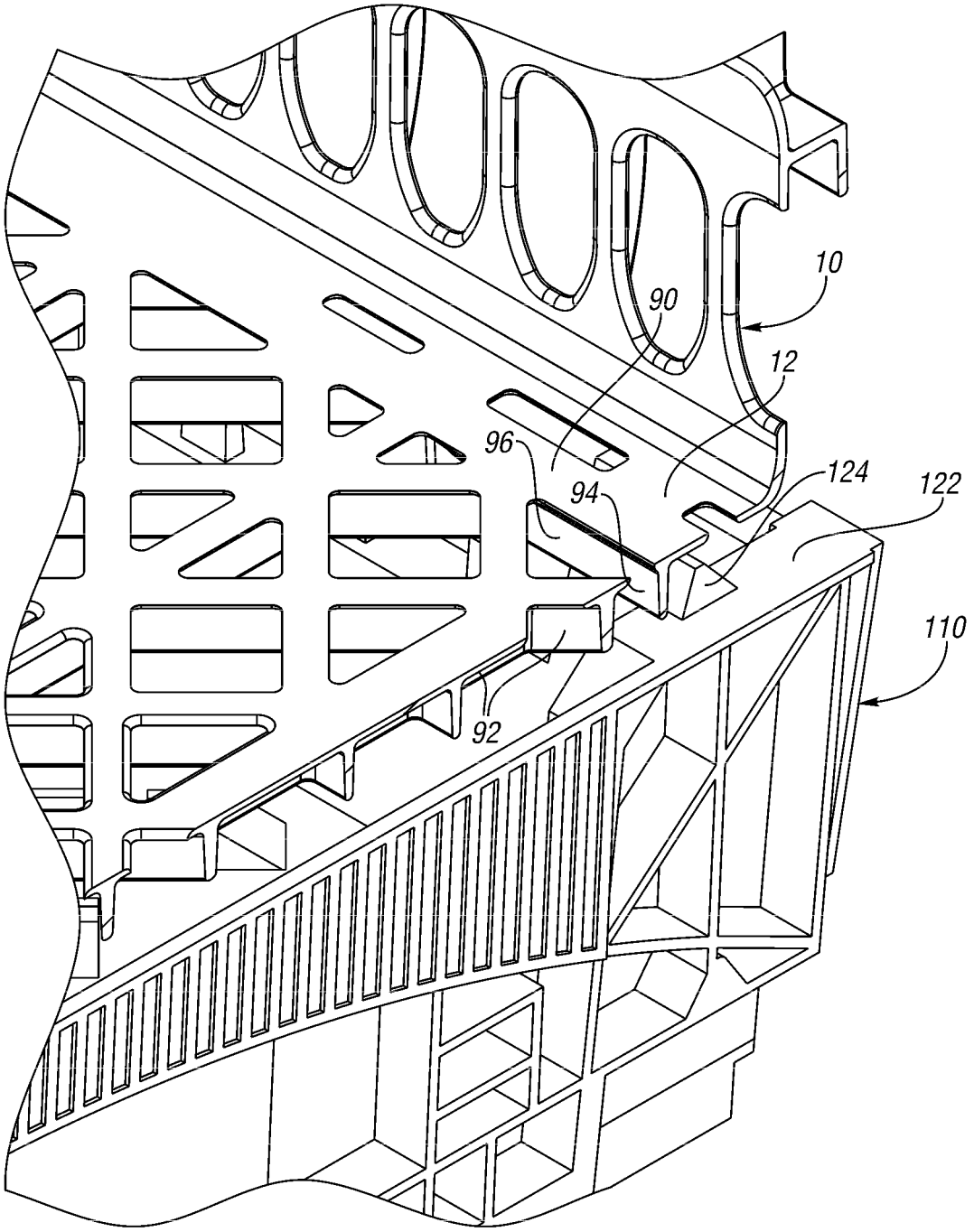
FIG. 20 is an enlarged view of a portion of FIG. 19.
Figure 21:
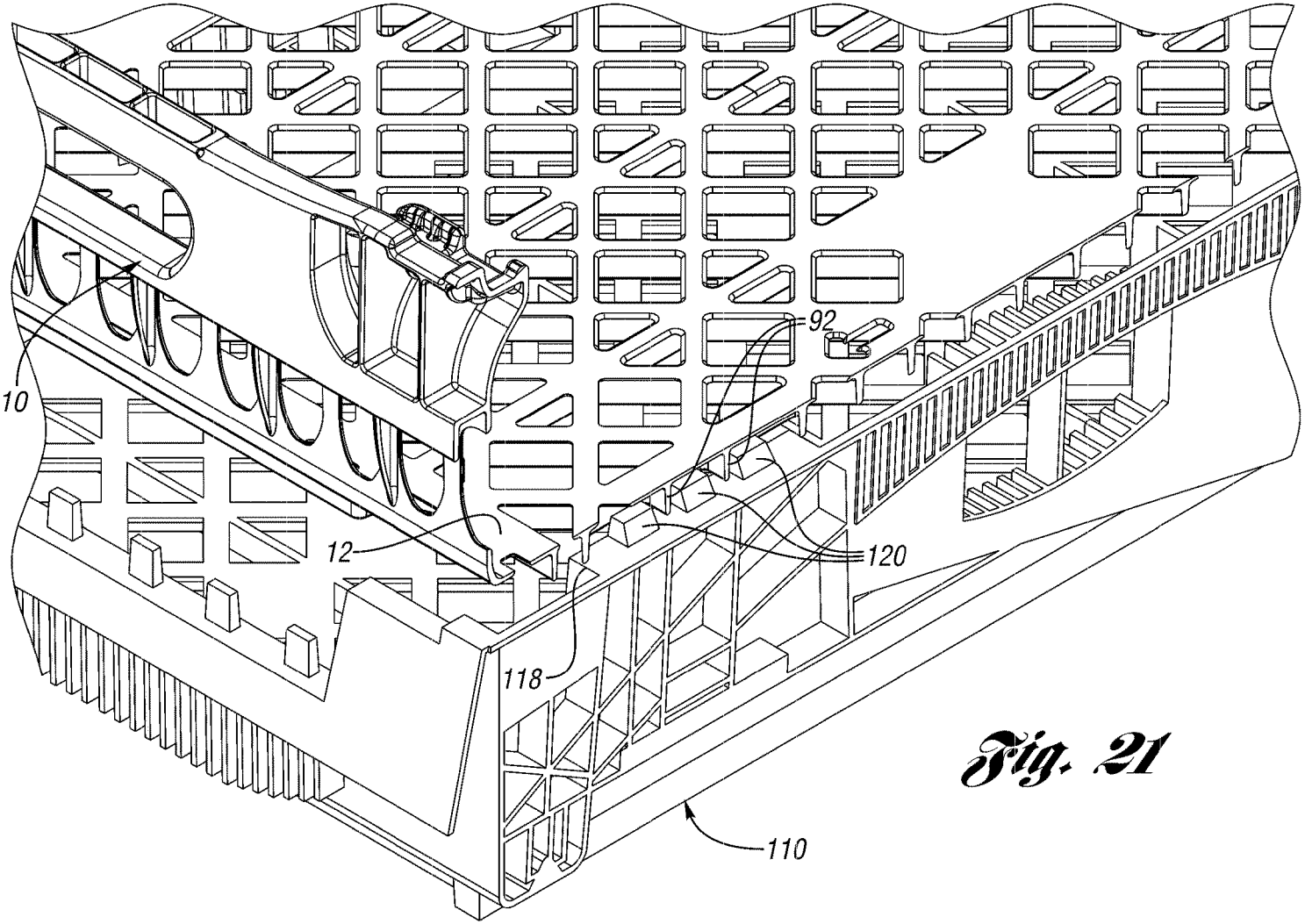
FIG. 21 is another enlarged view of a portion of FIG. 19.
Figure 22:
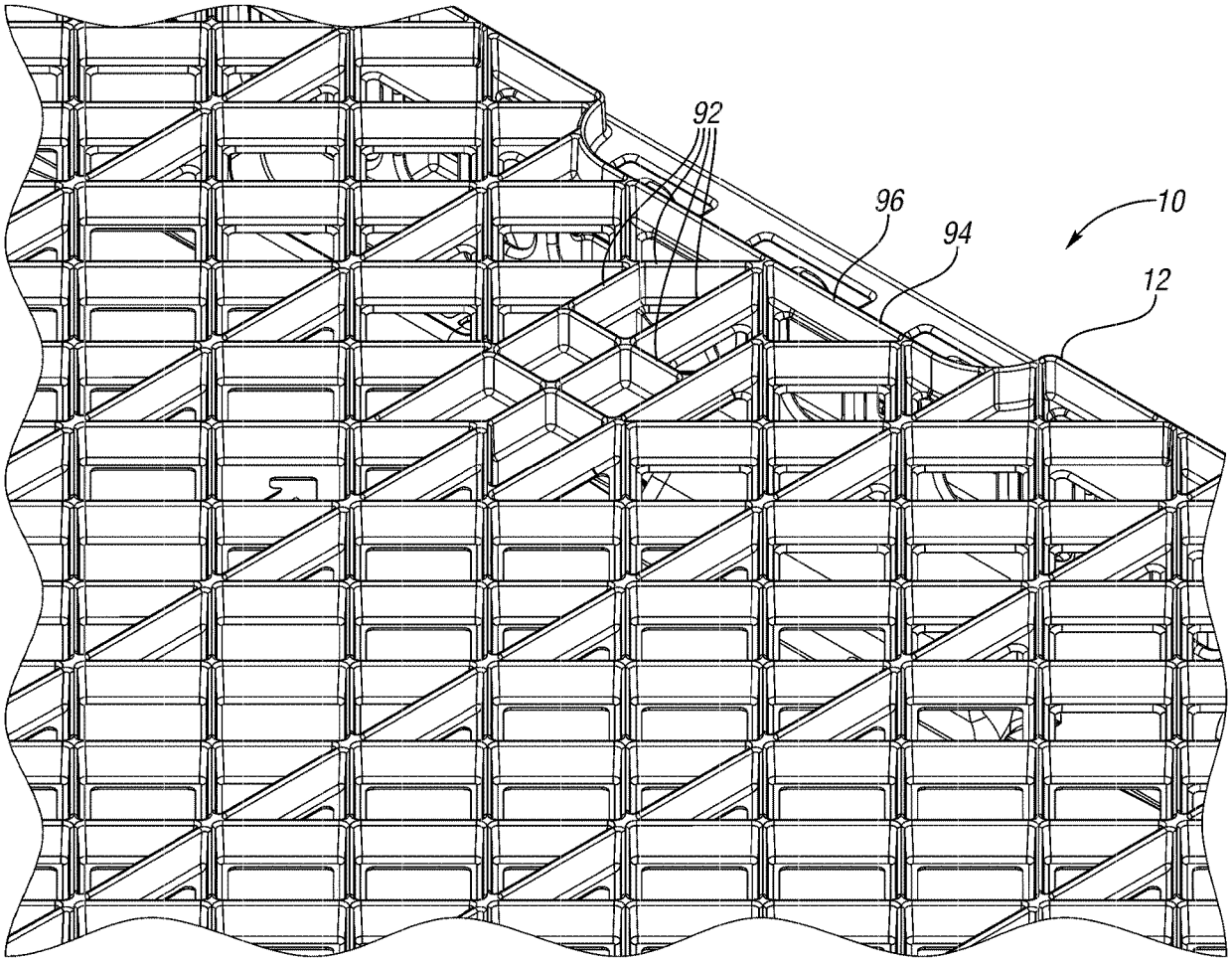
FIG. 22 is a bottom perspective view of a portion of the base of the tray.

FIGS. 19-21 show a halved tray 10 (for purpose of illustration) stacked on the prior art tray 110. Referring to FIG. 20, the base 12 of the tray 10 can be viewed as an upper, planar panel portion 90 from which a plurality of cross-ribs 92 extend downward. The recessed portion 96 of the peripheral rib 94 is supported on the upper support surface of the front column portion 122 inward of the single castellation 124. Referring to FIG. 21, the cross-ribs 92 of the base 12, are supported on the rear column portion 118 between the castellations 120. FIG. 22 is a bottom perspective view of the cross-ribs 92 and peripheral rib 94, showing the arrangement to accommodate the castellations 120, 124 (FIGS. 20-21).

Figure 23:
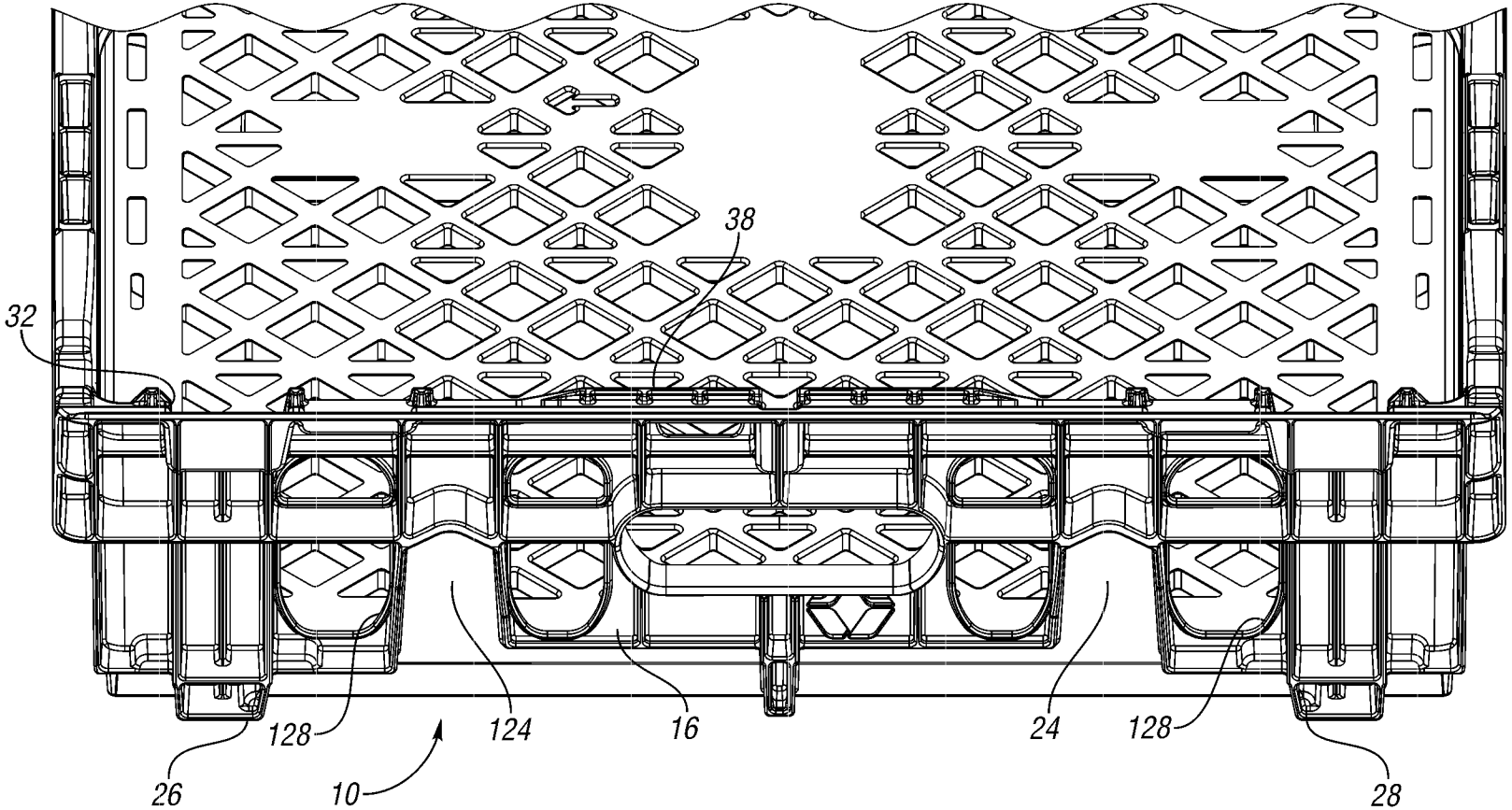
FIG. 23 is a perspective view of one side wall of the tray.
Figure 24:
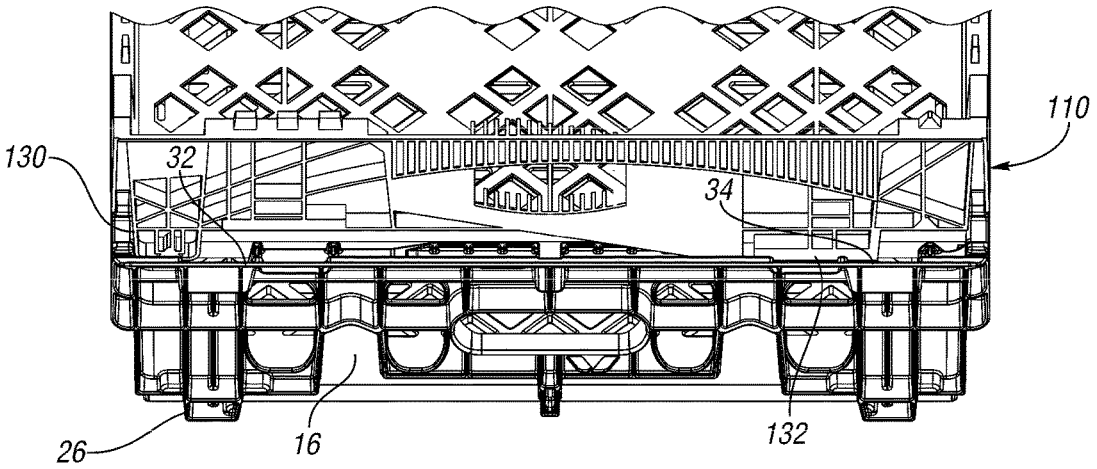
FIG. 24 shows the prior art tray in one orientation stacked on the side wall of FIG. 23.
Figure 25:
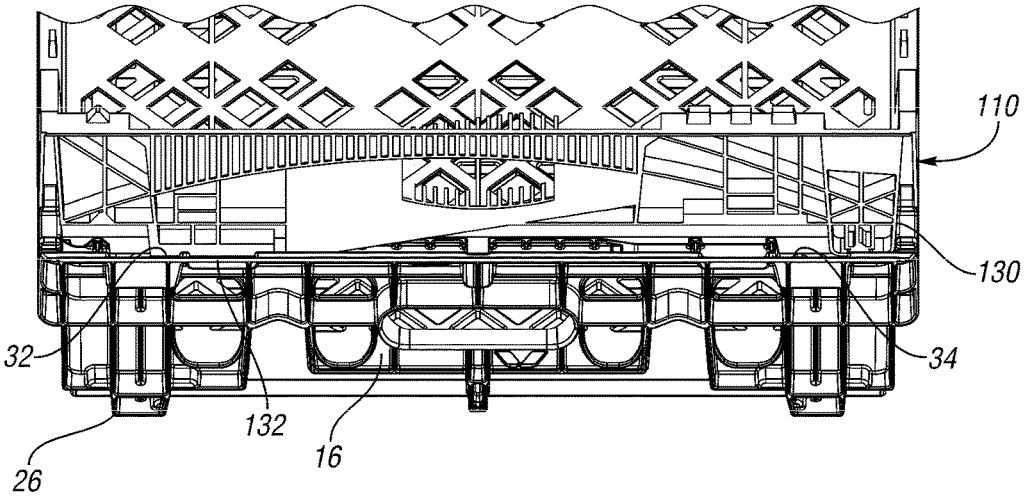
FIG. 25 shows the prior art tray in the other orientation stacked on the side wall of FIG. 23.

FIGS. 23-25 together illustrate the alignment of the prior art tray 110 on the side wall 16 of the tray 10. FIG. 23 shows the side wall 16. The rear foot 26 and front foot 28 are each outward of a window 128, which is outward of the interlocking recess 24. The rear recess 32 and front recess 34 are therefore also aligned outward of the windows 128.

Referring to FIG. 24, in one orientation, the rear foot 130 of the prior art tray 110 is supported on the side wall 16 outward of the recess 32, while the front foot 132 of the prior art tray is supported on the side wall 16 inward of the recess 34.

Referring to FIG. 25, in the other orientation, the rear foot 130 is supported outward of the recess 34, while the front foot 132 is supported inward of the recess 32.

Figure 26:
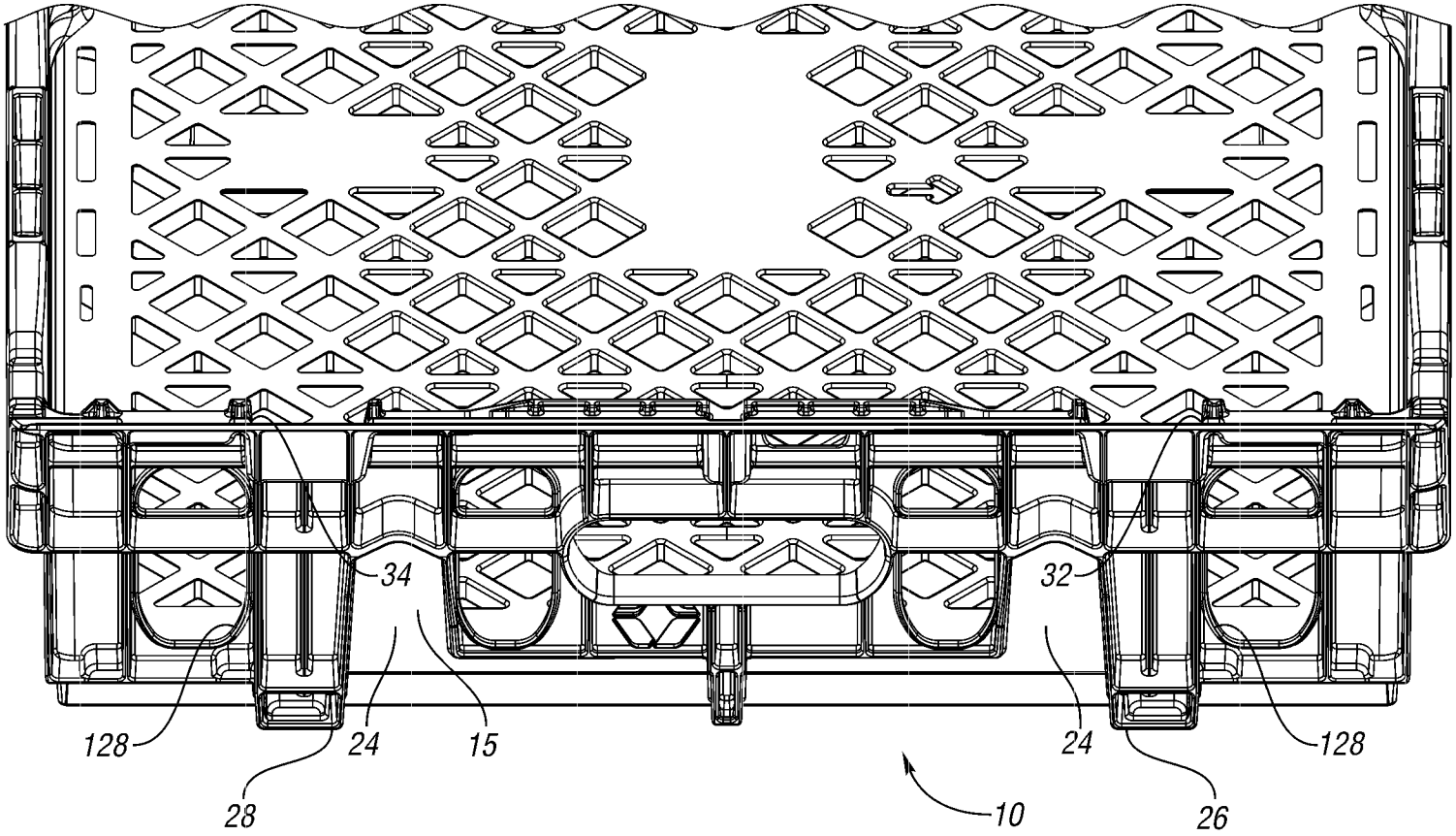
FIG. 26 is a perspective view of the other side wall of the tray.
Figure 27:
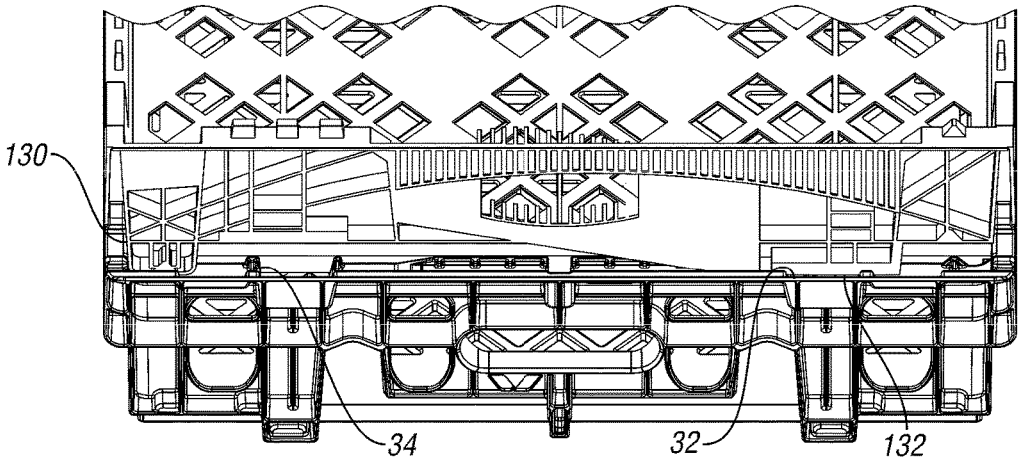
FIG. 27 shows the prior art tray stacked on the side wall of FIG. 26 in one orientation.
Figure 28:
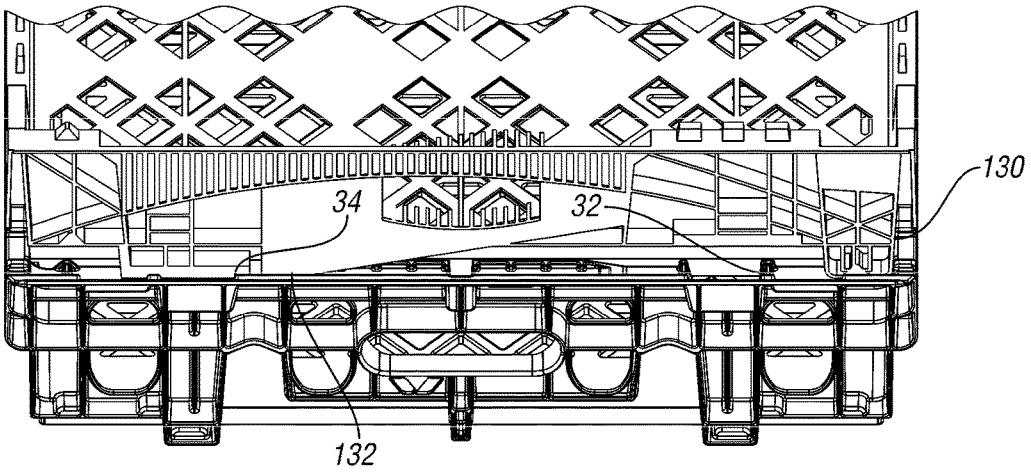
FIG. 28 shows the prior art tray stacked on the side wall of FIG. 26 in the other orientation.

FIGS. 26-29 illustrate the alignment of the prior art tray 110 on the side wall 15 of the tray 10. FIG. 26 shows the side wall 15. The rear foot 26 and front foot 28 are each inward of a window 128 and immediately adjacent the interlocking recess 24. The rear recess 32 and front recess 34 are therefore also aligned inward of the windows 128. FIG. 27 shows one orientation of the prior art tray 110, in which the rear foot 130 of the prior art tray 110 is supported on the side wall 16 outward of the recess 34, while the front foot 132 of the prior art tray is supported on the side wall 16 outward of the recess 32. Referring to FIG. 28, in the other orientation, the rear foot 130 is supported outward of the recess 32, while the front foot 132 is supported inward of the recess 34.

Figure 29:
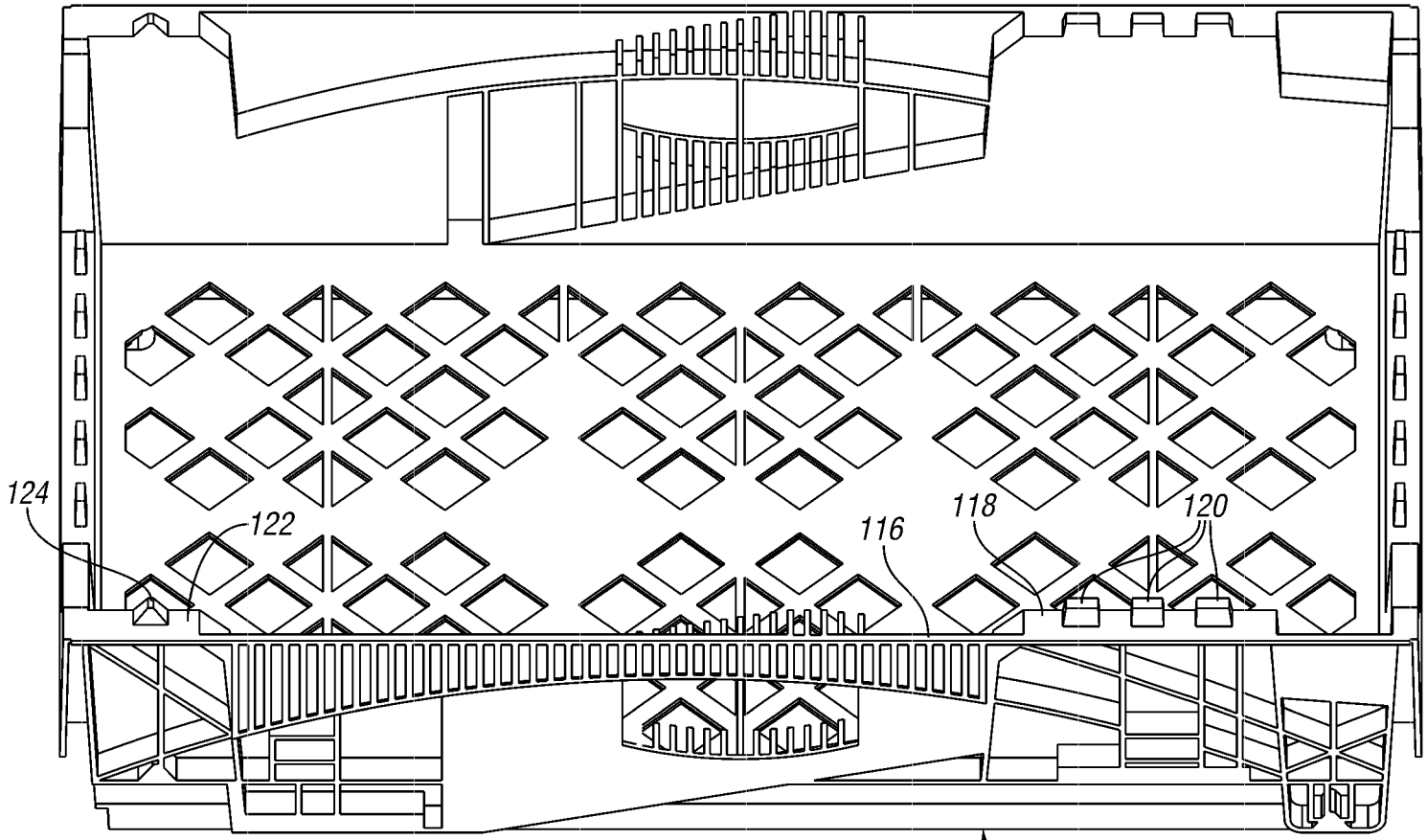
FIG. 29 is a perspective view of one side wall of the prior art tray.
Figure 30:
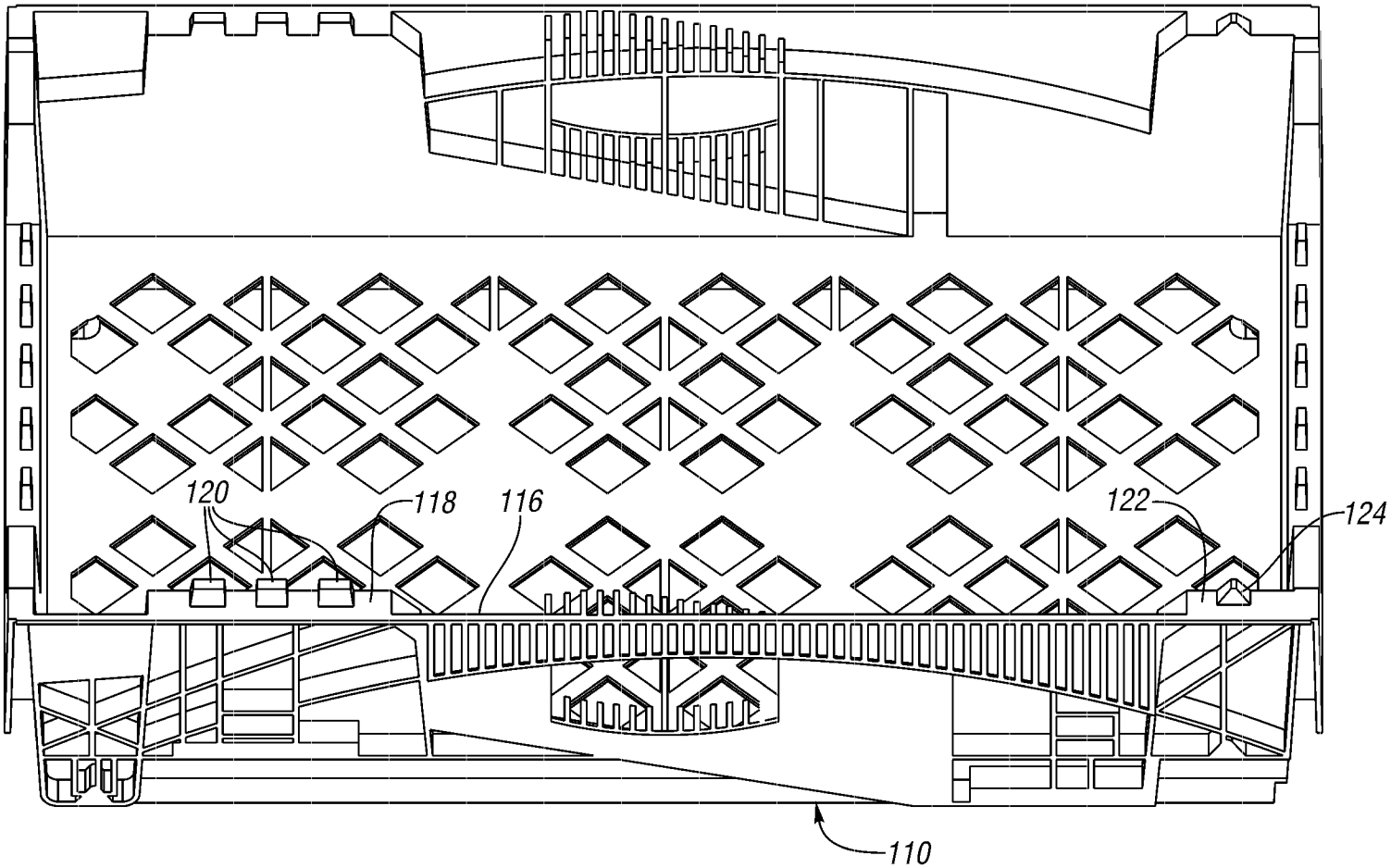
FIG. 30 is a perspective view of the other side wall of the prior art tray.
Figure 31:
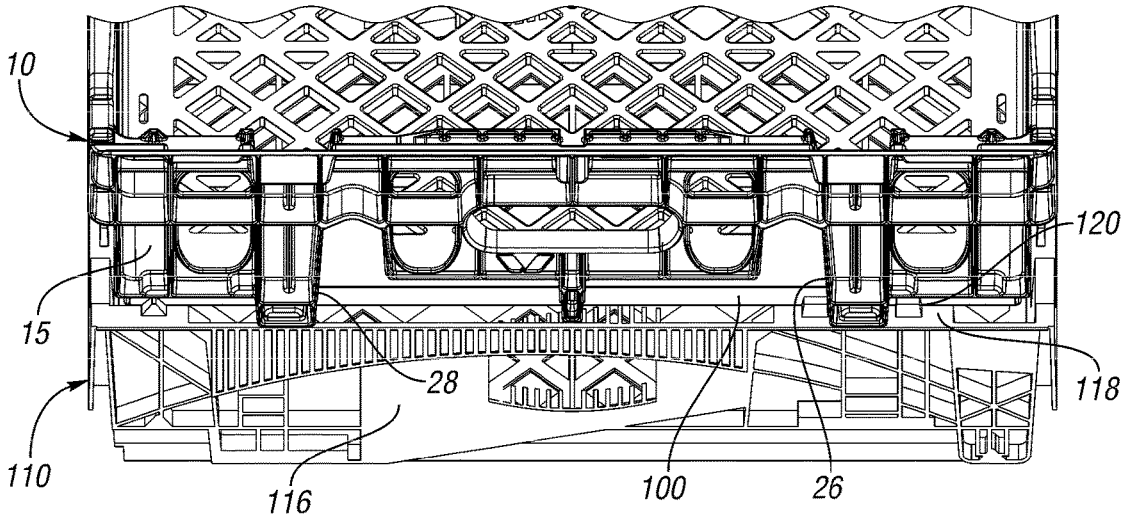
FIG. 31 shows one side wall of the tray stacked on one of the side walls of the prior art tray.
Figure 32:
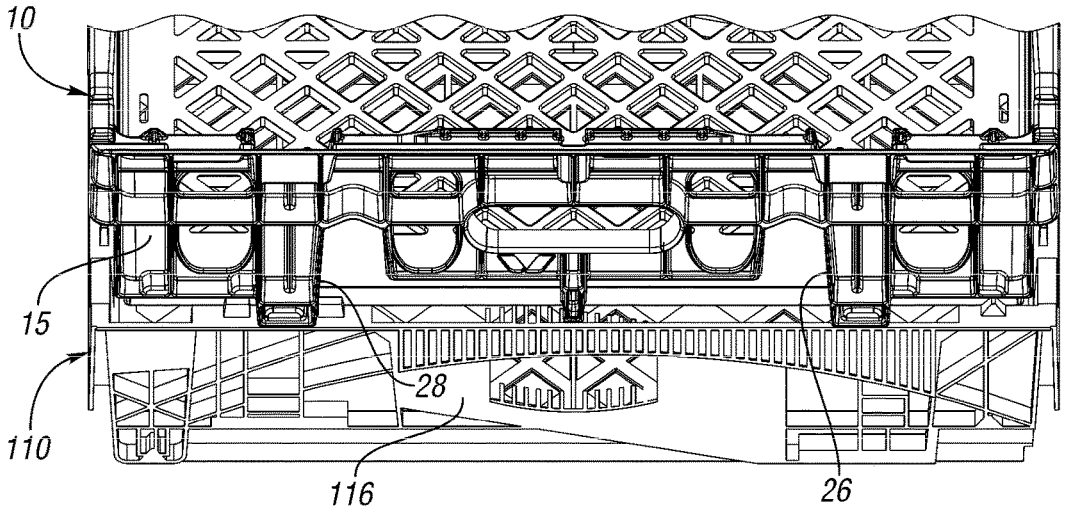
FIG. 32 shows the tray stacked on the other side wall of the prior art tray.

FIGS. 29 and 30 are upper perspective views of the side walls 116 of the prior art tray 110. FIGS. 31 and 32 show the side wall 15 of the tray 10 stacking on the side walls 116 of the prior art tray 110. In FIG. 31, the front foot 28 is stacked on the side wall 116, while the rear foot 26 is stacked on the rear support column 118. One of the castellations 120 is received in the central recess 27 (FIG. 4) of the rear foot 26, adjacent the drag rail 100. On the other side wall 116, shown in FIG. 32, the rear foot 26 is stacked on the side wall 116, while the front foot 28 is stacked on the rear support column 118, with one of the castellations 120 received in the central recess 27 (FIG. 4) of the front foot 28, adjacent the drag rail 100.

Figure 33:
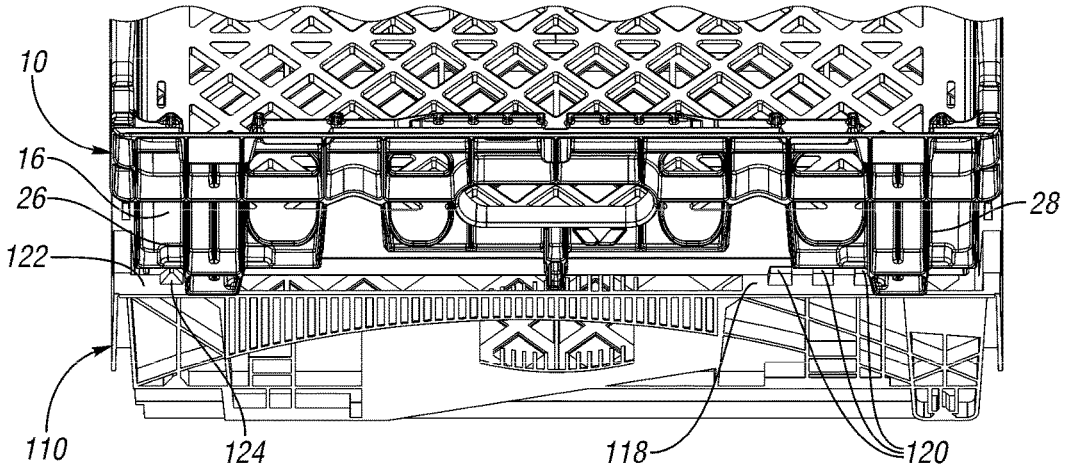
FIG. 33 shows the other side wall of the tray stacked on one of the side walls of the prior art tray.
Figure 34:
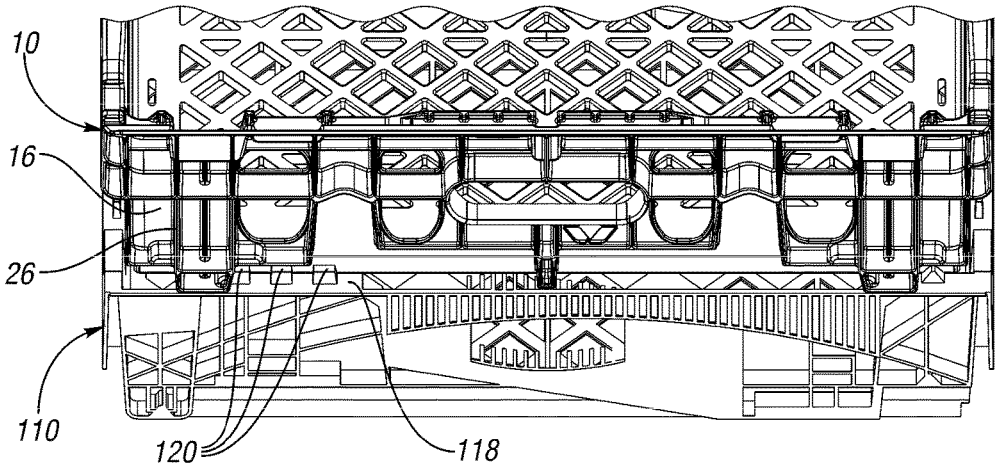
FIG. 34 shows the other side walls of the tray stacked on the other side wall of the prior art tray.
Figure 35:
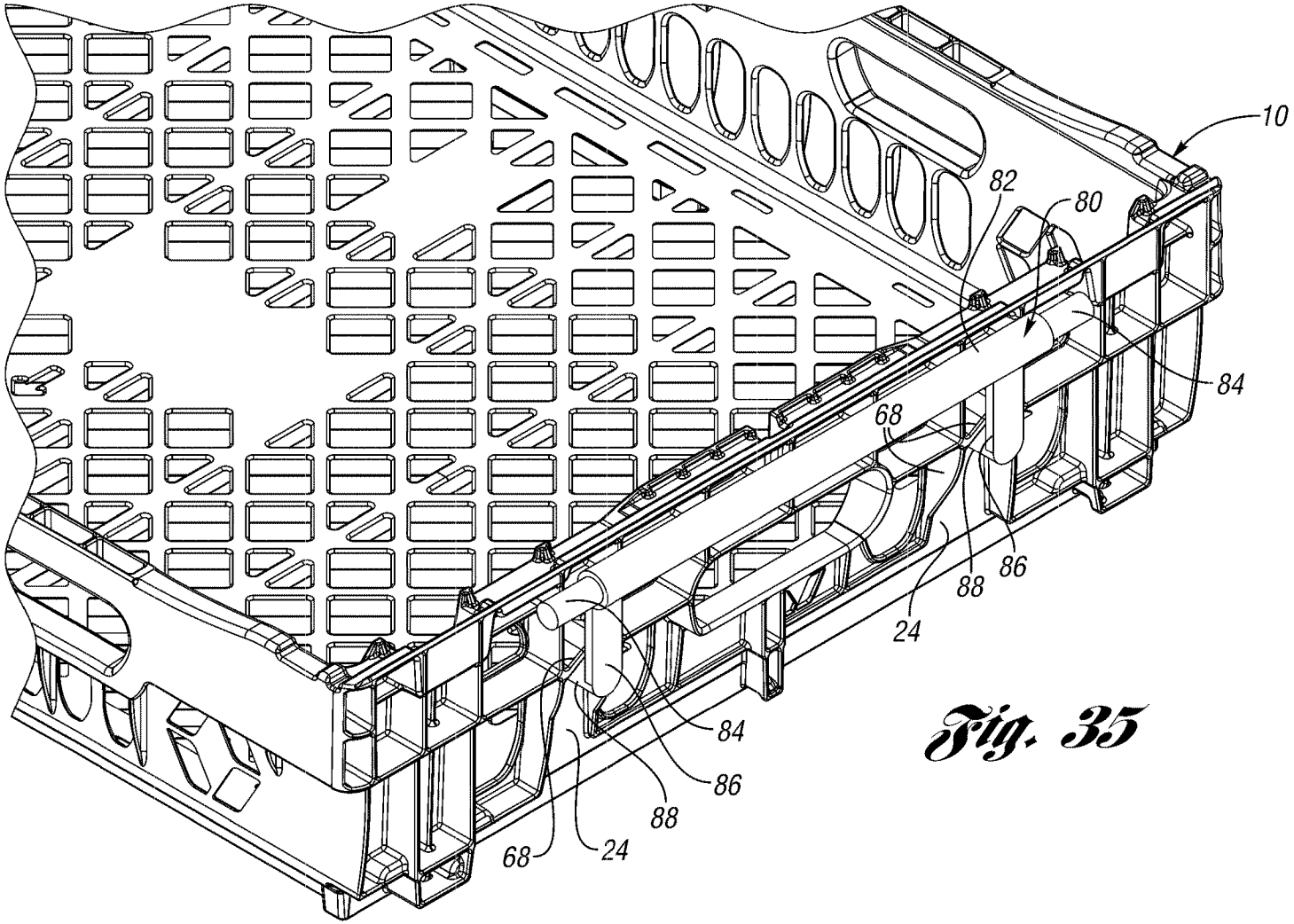
FIG. 35 is a perspective view of one side wall of the tray having a portion of automated handling equipment engaged therewith.
Figure 36:
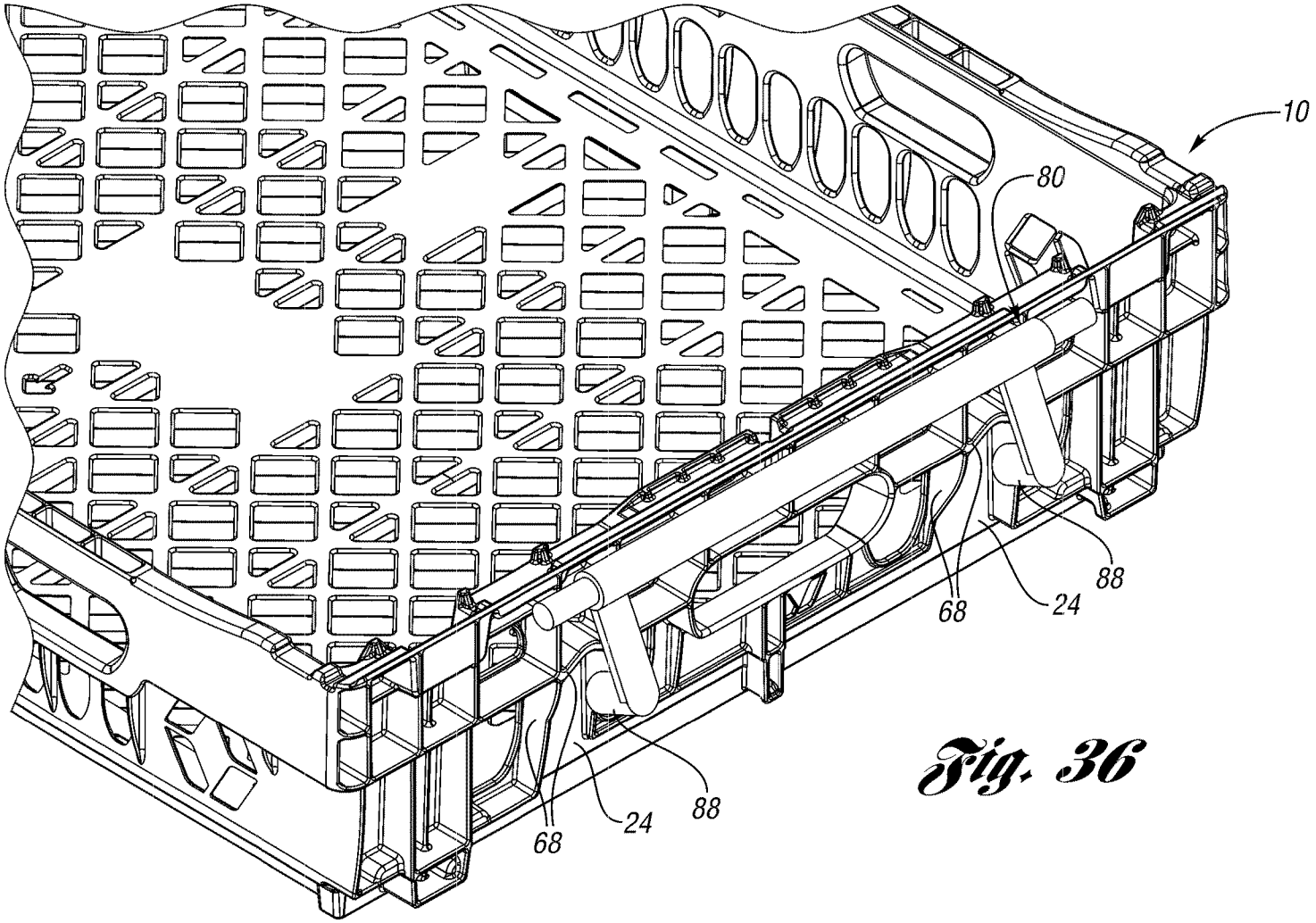
FIG. 36 shows the side wall of FIG. 35 with the automated handling equipment disengaged therefrom.

FIGS. 33 and 34 show the side wall 16 of the tray 10 stacking on the side walls 116 of the prior art tray 110. In FIG. 33, the front foot 28 is stacked on the rear support column 118, with one of the castellations 120 received in the lateral recess 29 (FIG. 4) of the front foot 28, adjacent the drag rail 100. The rear foot 26 is stacked on the front support column 122. On the other side wall 116, shown in FIG. 34, the rear foot 26 is stacked on the rear support column 118, with one of the castellations 120 received in the lateral recess 29 (FIG. 4) of the rear foot 26, adjacent the drag rail 100. The front foot 28 is stacked on the front support column 122.

Figure 37:
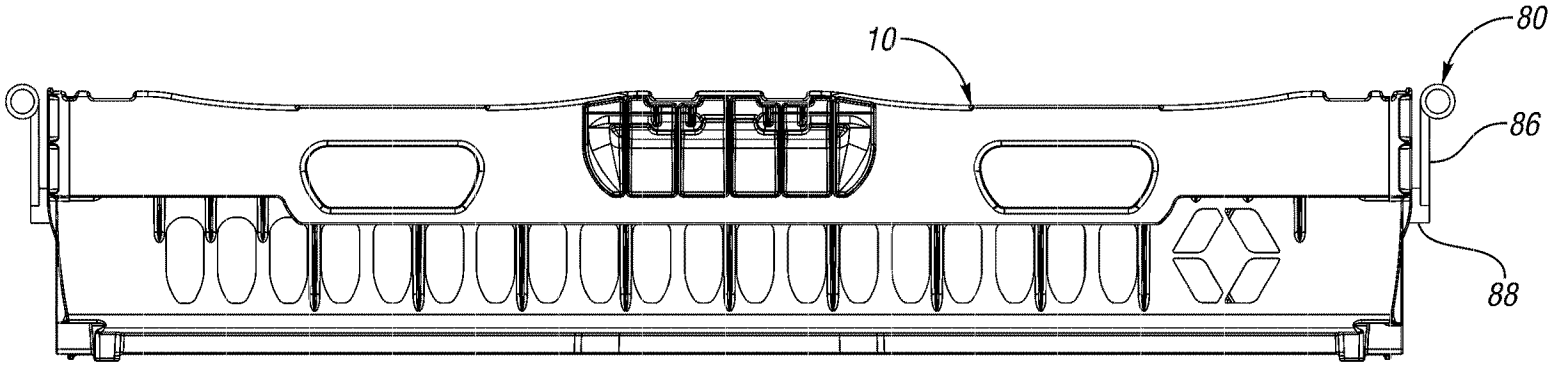
FIG. 37 is a front view of the tray and the automated handling equipment engaged therewith.
Figure 38:
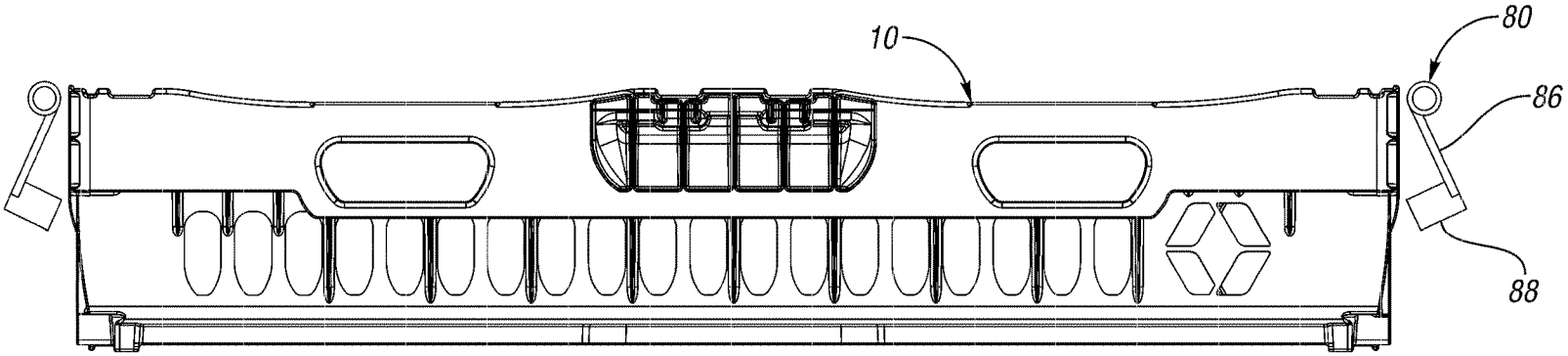
FIG. 38 is a front view of the tray with the automated handling equipment disengaged therefrom.

Automated handling equipment may include a lifting and pulling device, such as the device 80 shown in FIGS. 35-38. The device 80 includes a center bar 82 having hinge pins 84 projecting from each axial end. Arms 86 extend downward from the center bar 82. A projection 88 is formed at the outer end of each arm 86. As shown in FIGS. 37 and 38, the device 80 can be used to engage the interlocking recesses 24 in either end of the tray 10. The projection 88 at the end of each arm 86 provides some self-alignment between the device 80 and the tray 10. The device 80 can lift and pull the tray 10.

Figure 39:
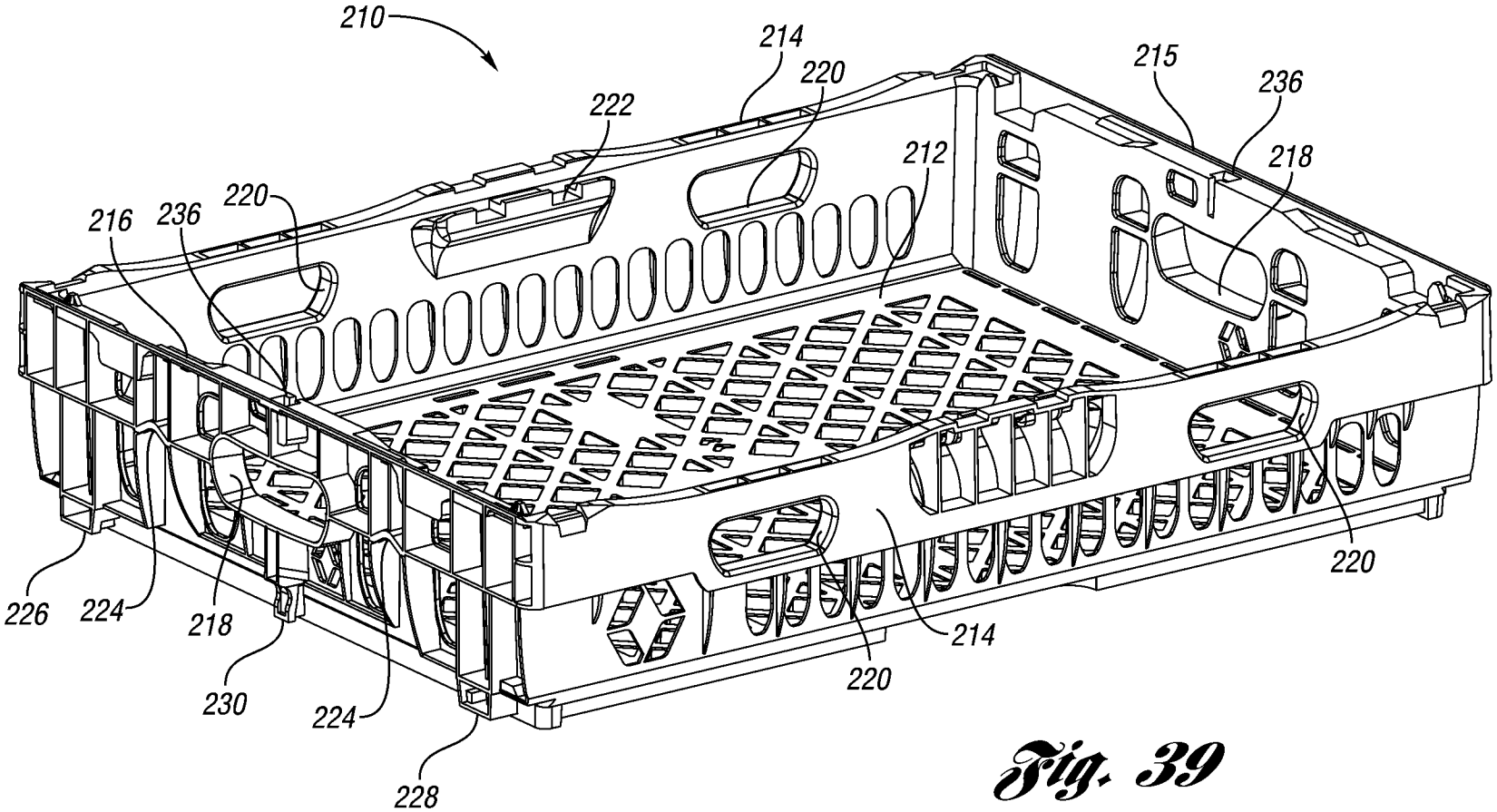
FIG. 39 is a perspective view of a bakery tray according to a second embodiment.

FIG. 39 is a perspective view of a bakery tray 210 according to a second embodiment. The bakery tray 210 is identical to the tray 20 of the first embodiment except as otherwise described below or as shown in the Figures. The bakery tray 210 generally includes a base 212, front and rear walls 214 extending upwardly from front and rear edges of the tray 210, and side walls 215, 216 extending upwardly from side edges of the base 212. The side walls 215, 216 include handles 218 formed therein. Each of the front and rear walls 214 includes a platform 222 projecting inwardly adjacent an upper edge thereof and centered between the handles 220.

Each of the side walls 215, 216 includes a pair of interlocking recesses 224 for interlocking with automated handling equipment. Each side walls 215, 216 further includes a rear foot 226, front foot 228, and center projection 230 projecting downwardly. Recesses in the upper edge of the side walls 215, 216 provide for different stacking heights; however, in this embodiment, the recesses for the high stacking position are positioned directly above the feet 226, 228 so that load can transfer directly from foot to foot in the high stacking position (in the low stacking position, there are many other contact areas between the upper tray and the lower tray in addition to the feet in the low-stacking recesses).

An upper edge of each side wall 215, 216 includes a center recess 236 above the handles 218 and aligned with the center projection 230.

Figure 40:
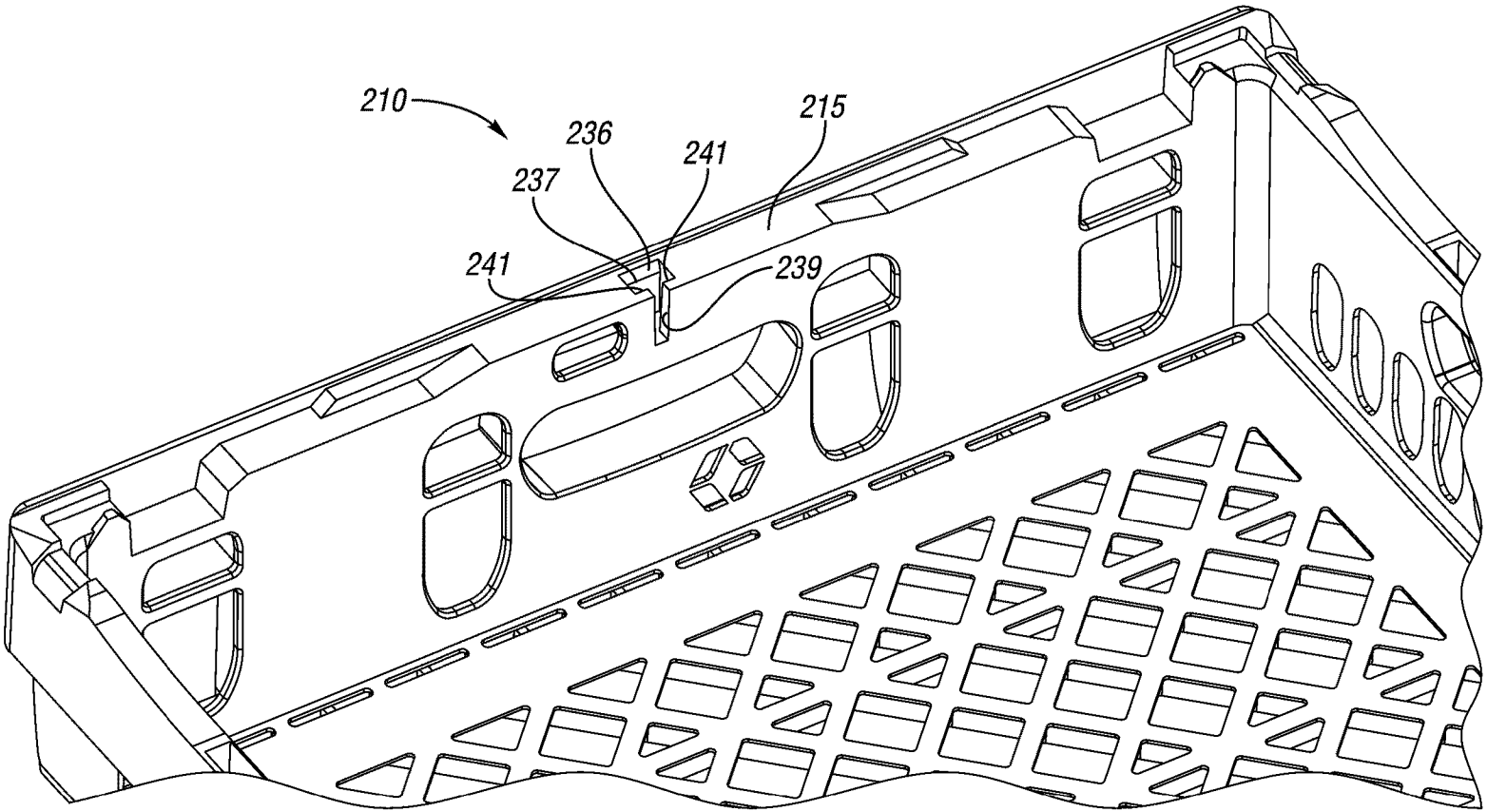
FIG. 40 is an interior perspective view of one side wall of the tray of FIG. 39.

The center recess 236 is shown more clearly in FIG. 40. The center recess 236 is T-shaped including a large portion 237 and a narrow portion 239, as defined by two wall portions 241.

Figure 41:
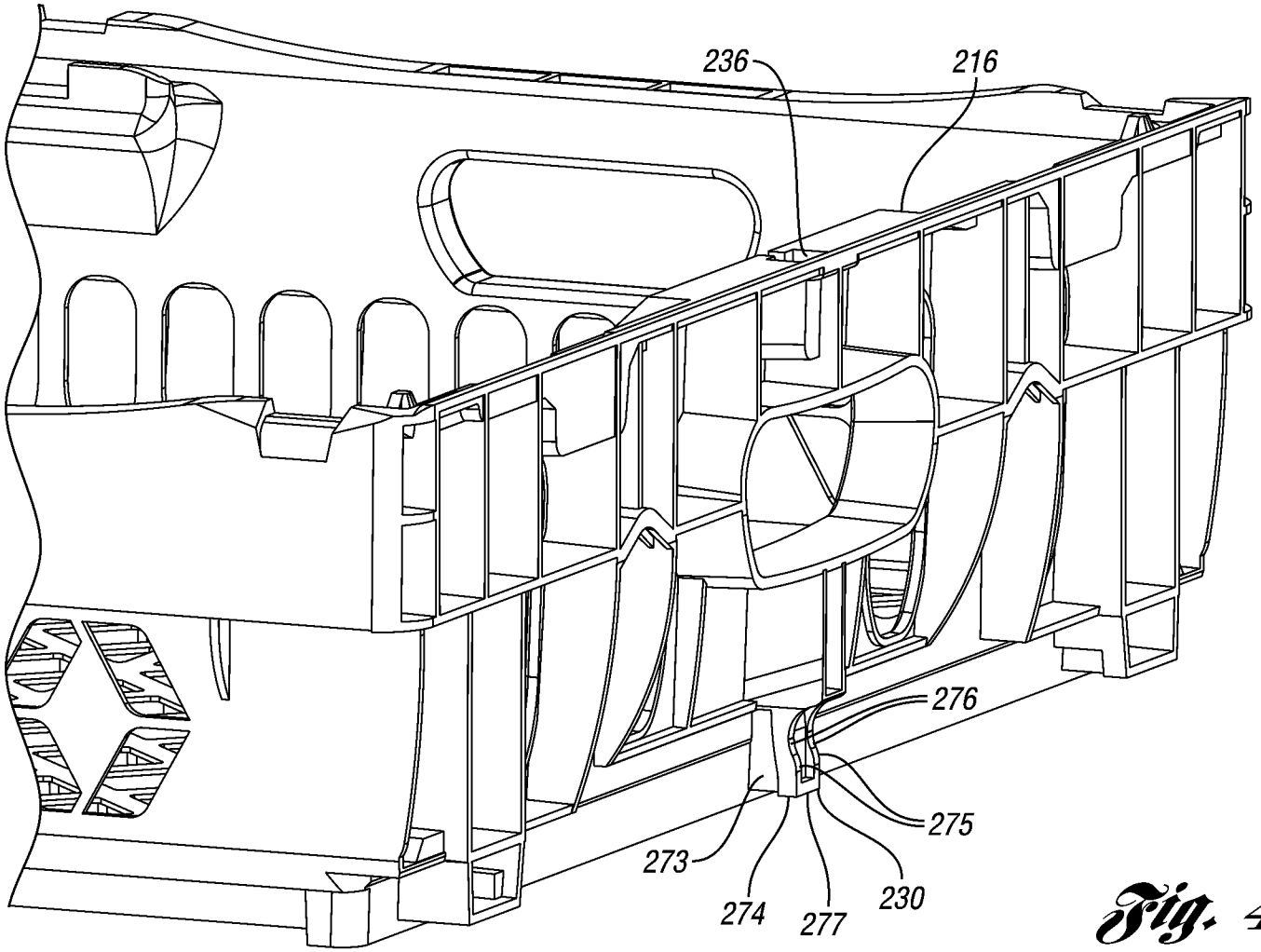
FIG. 41 is an exterior perspective view of one of the side walls of the tray of FIG. 39.

The center projection 230 is shown in more detail in FIG. 41. The center projection 230 is also T-shaped, having a single-wall thickness base rib 273 extending outward from the side wall 216 (the projection side wall 215 can be identical) to outer cross portion 274 generally parallel to the side wall 216. Outer cross portion 274 includes a pair of vertical ribs 275 each having a tapered, narrow portion 276 above their bottom edges and above the bottom edge of the outer cross portion 274. The narrow portions 276 are preferably curved, concave portions. A bottom horizontal rib 277 extends across the bottom of the vertical ribs 275 defining the bottom of the cross portion 274.

Figure 42:
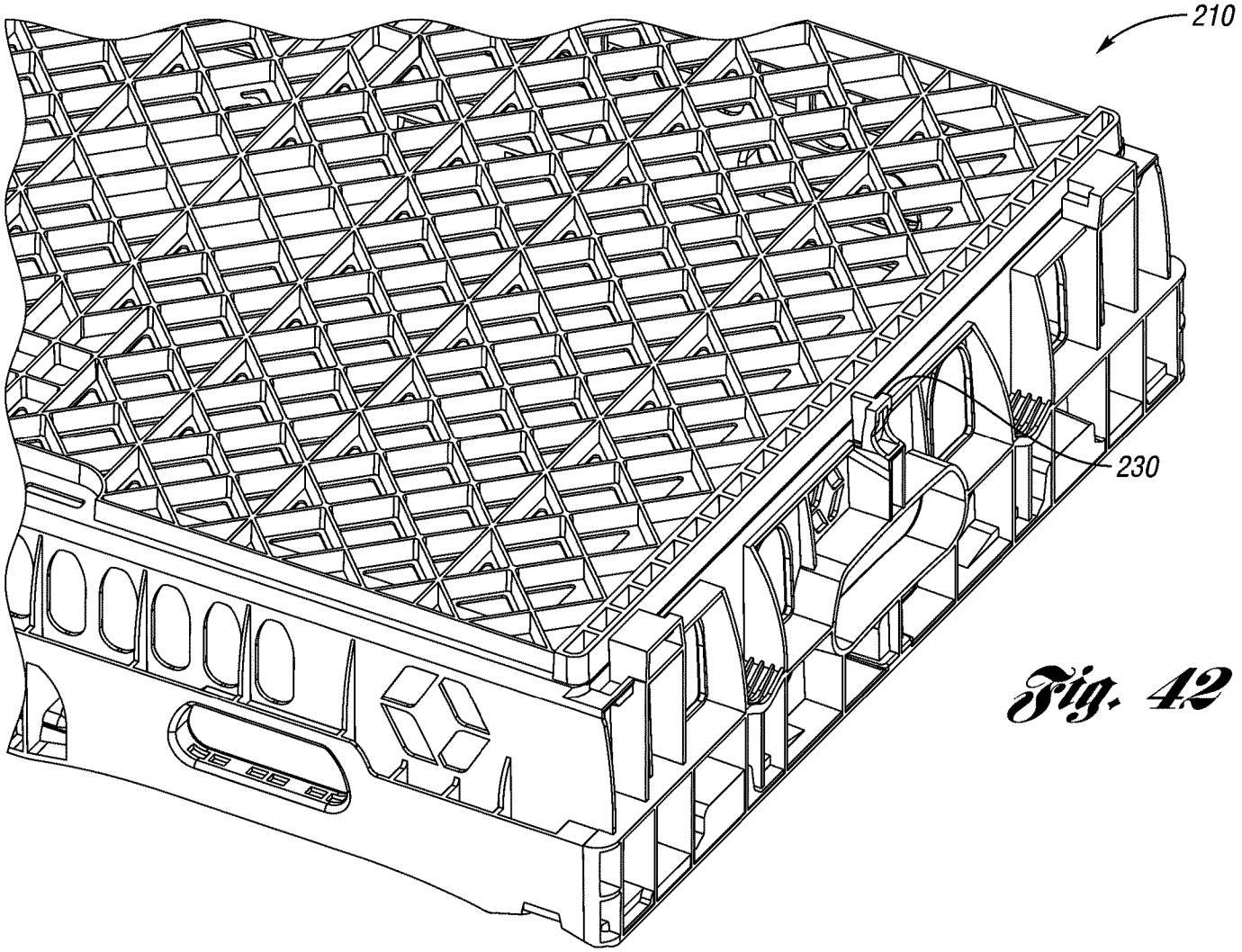
FIG. 42 is a bottom perspective view of the side wall of FIG. 41.

A bottom view of the tray 210 is shown in FIG. 42, where the center projection 230 is also shown.

Figure 43:
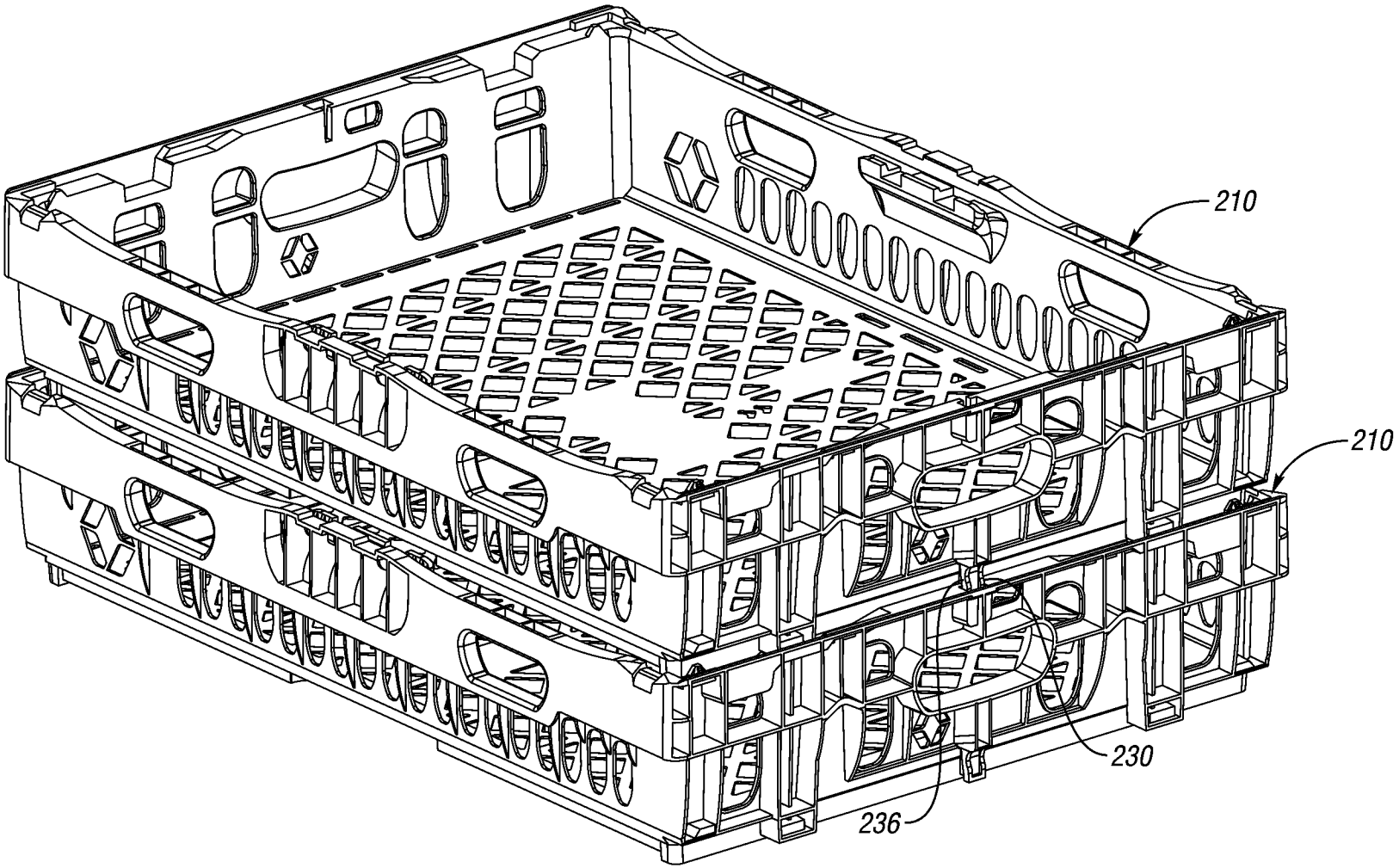
FIG. 43 shows the tray of FIG. 39 with an identical tray stacked thereon in the high stacked position.
Figure 44:
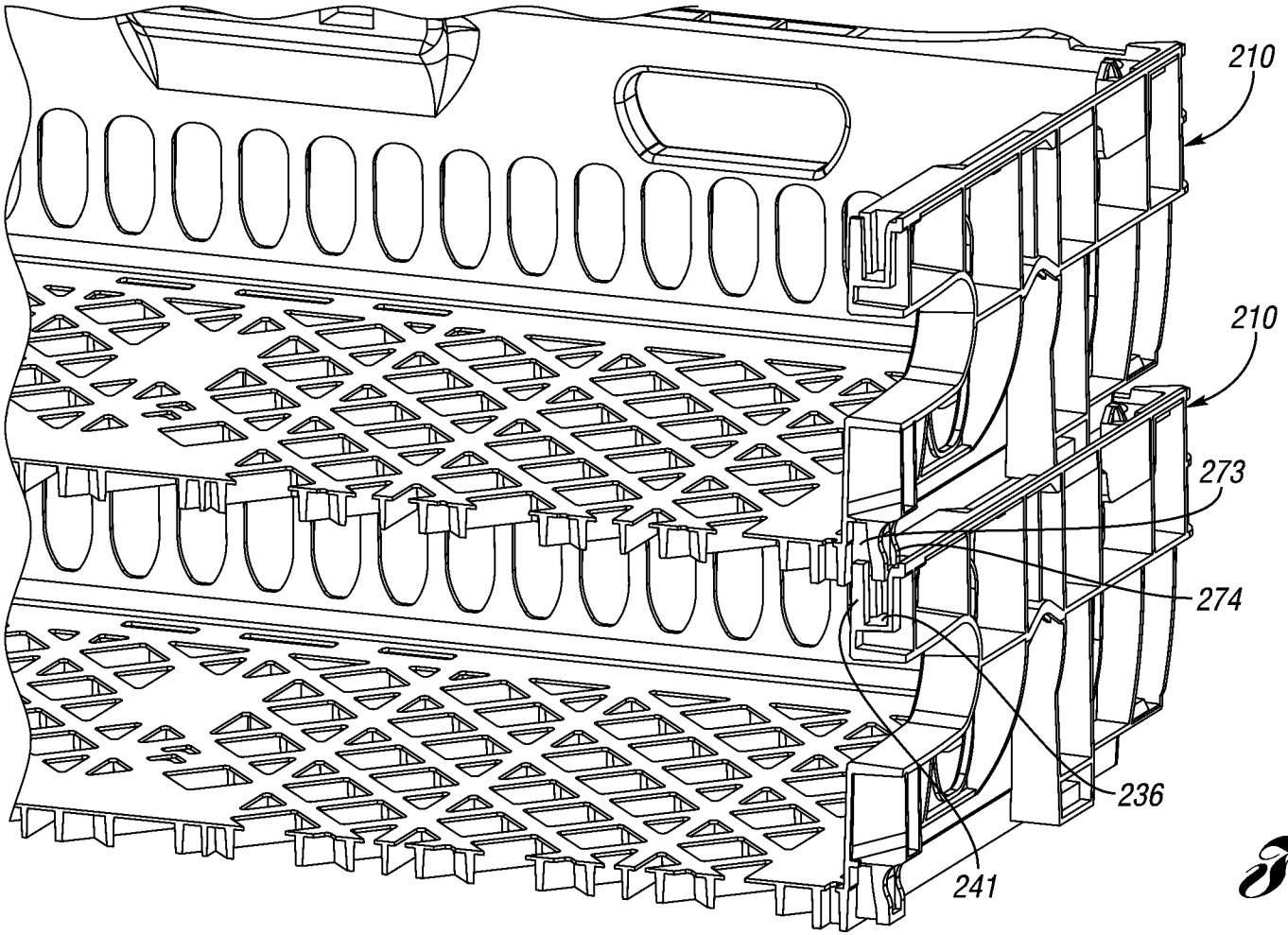
FIG. 44 is a section view through the trays of FIG. 43.

In FIG. 43, the tray 210 is shown with an identical tray 210 stacked thereon in the high stack position. The center projection 230 of the upper tray 210 is partially received in the center recess 236 of the lower tray 210. The interlocking T-shapes of the center projection 230 and center recess 236 prevent the side walls 215, 216 of the lower tray 210 from bowing outward under the weight of the tray 210 and numerous other trays 210 stacked in turn thereon, which may each be loaded with goods. As shown in FIG. 44, the base rib 273 of the center projection 230 is received between the wall portions 241 of the center recess 236, thereby capturing the cross portion 274 of the center projection 230 of the upper tray 210, thereby preventing the side wall of the lower tray 210 from bowing outward.

Figure 45:
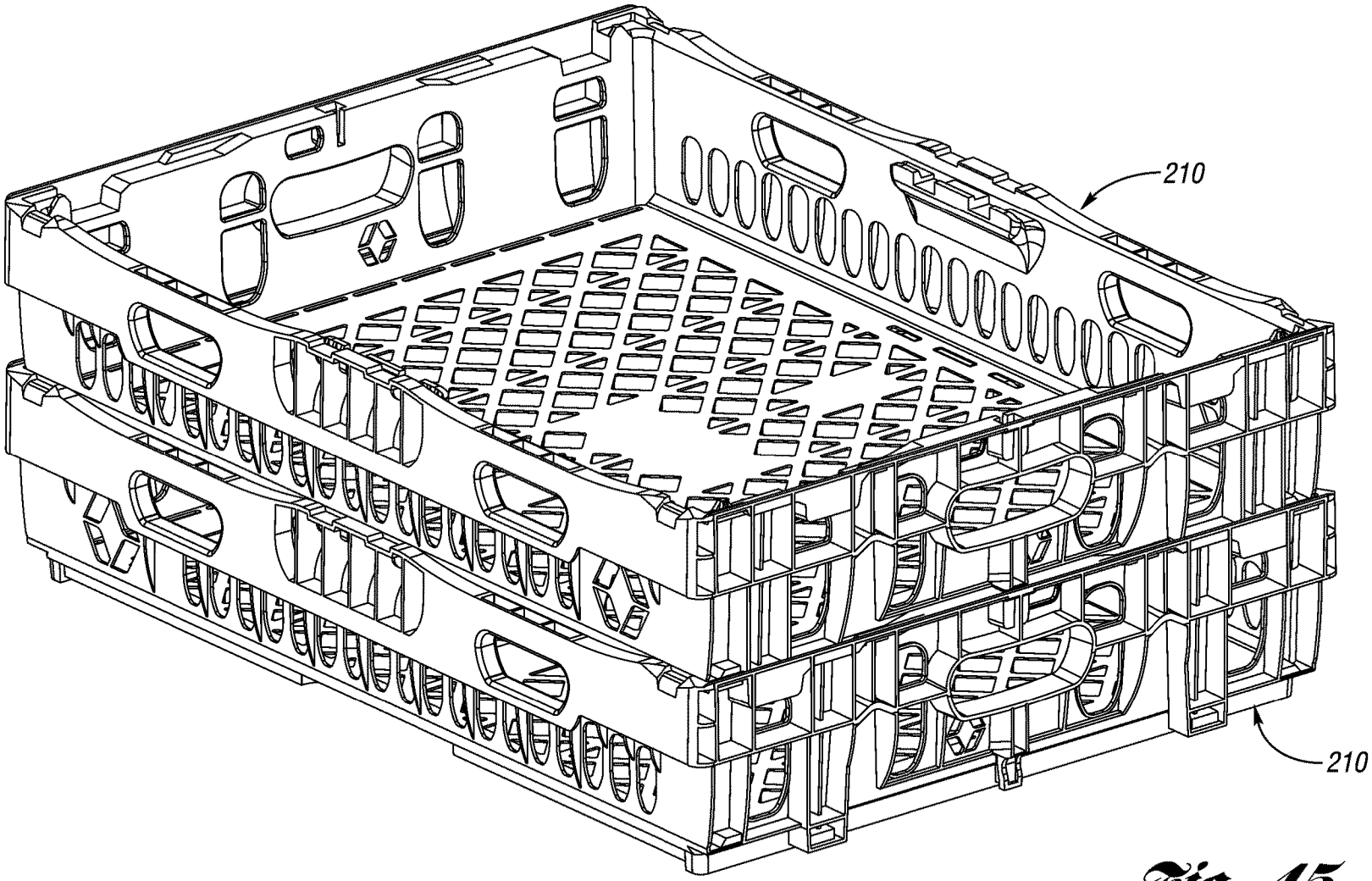
FIG. 45 is a perspective view of the trays of FIG. 43 in the low stacked position.
Figure 46:
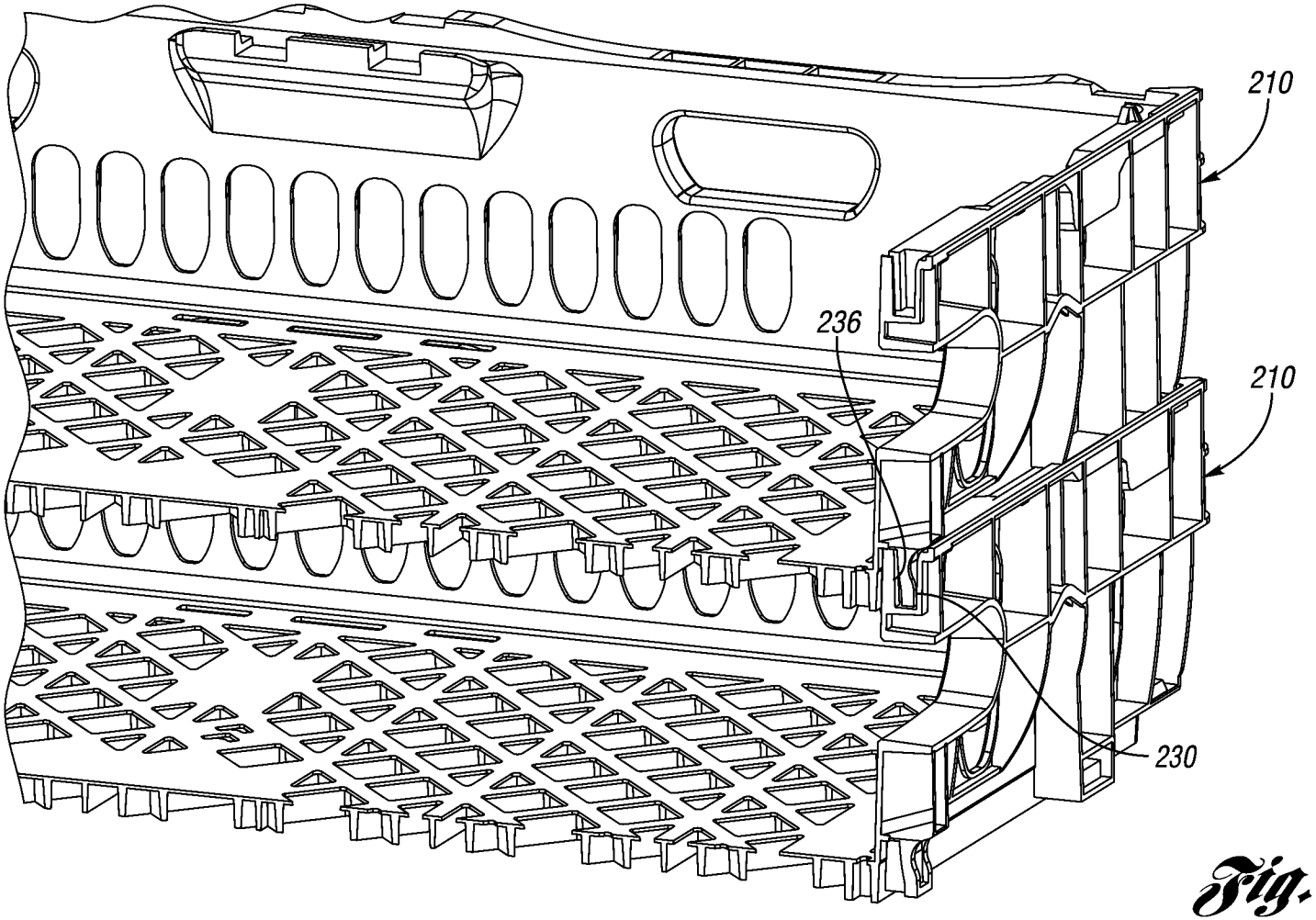
FIG. 46 is a section view through the trays of FIG. 45.

In FIGS. 45 and 46, the trays 210 are in the low stacked position. The center projection 230 of the upper tray 210 is received fully within the center recess 236 of the lower tray 210.

Figure 47:
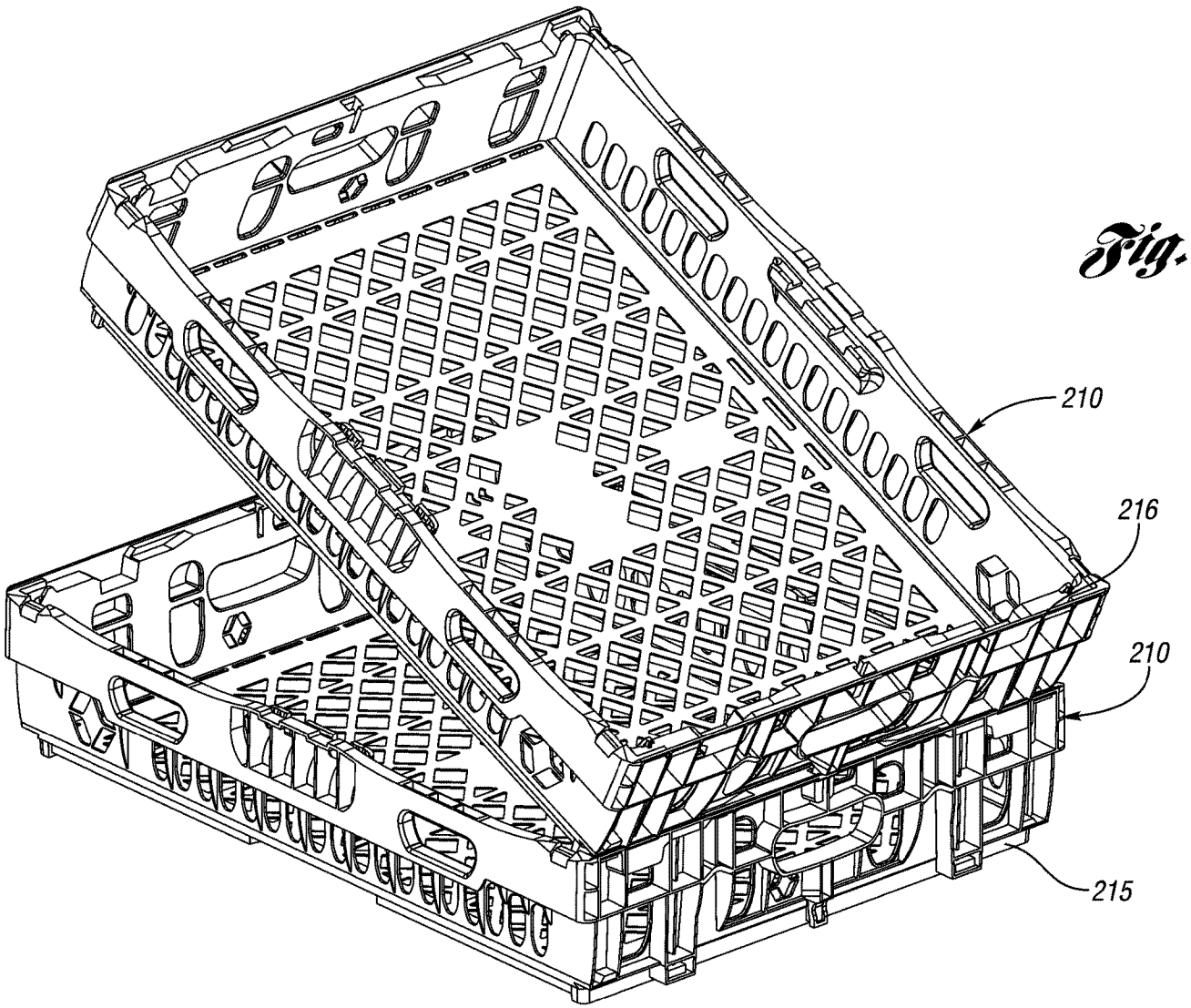
FIG. 47 is a perspective view of the trays of the FIG. 45 with the upper tray being lifted at one end.
Figure 48:
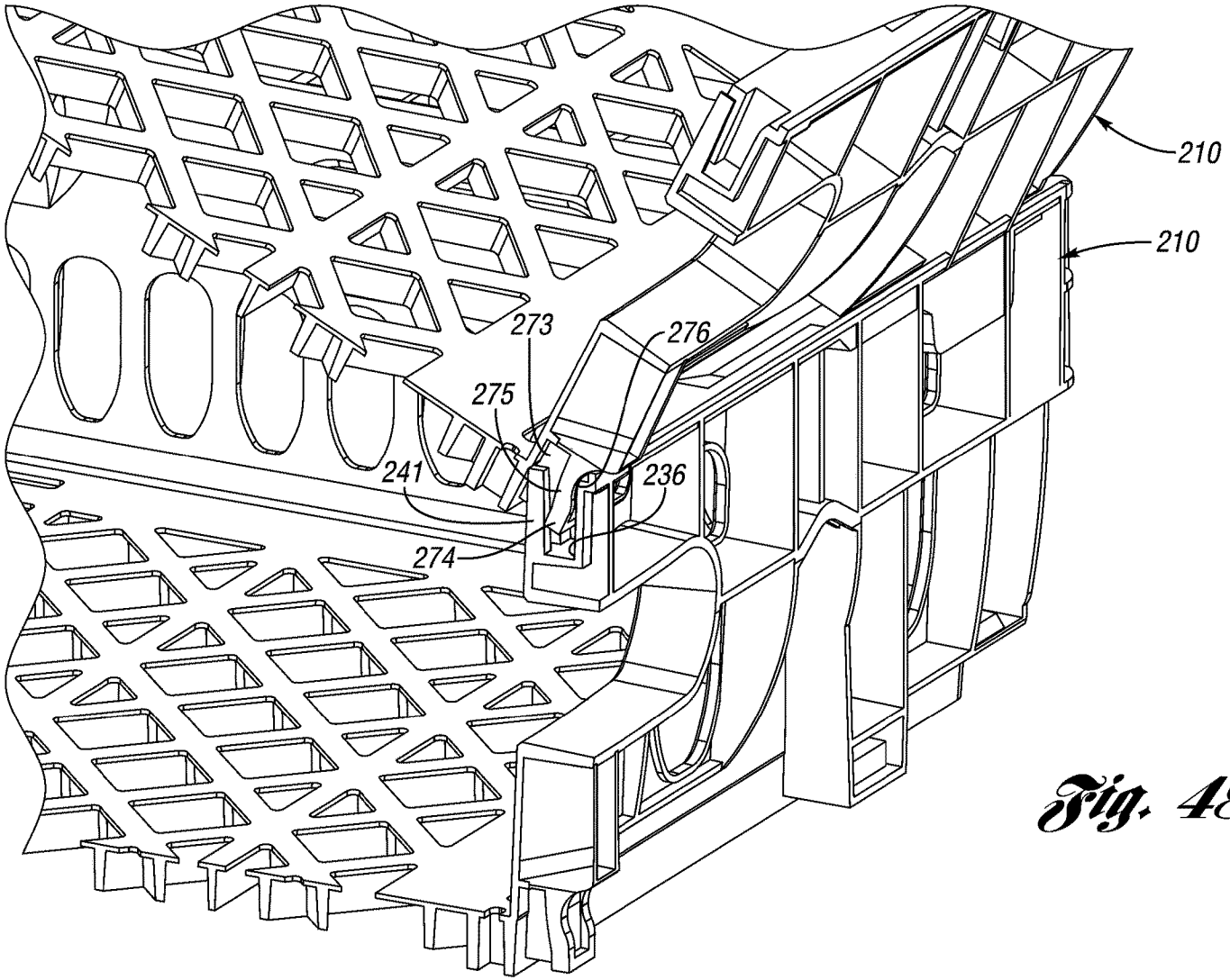
FIG. 48 is a section view through the trays of FIG. 47.

If the upper tray 210 is lifted at the opposite side, as shown in FIGS. 47 and 48, this pivots the center projection 230 within the center recess 236. The narrow portions 276 of the vertical ribs 275 accommodate and receive the front edge of the side wall as the upper tray 210 is pivoted. Thus, the center projection 230 reinforces the side wall of the lower tray 210 during stacking, but also permits the upper tray 210 to pivot when stacked.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray comprising:

a base;

a plurality of walls extending upward from the base, including a first pair of walls each having an inner wall portion extending upward from the base, wherein the each of the first pair of walls includes a double-walled lip portion that projects outwardly relative to a lower portion, wherein the double-walled lip portion includes the inner wall portion and an outer wall portion spaced outward of the inner wall portion, an interior of the tray defined between inner surfaces of the inner wall portions, the plurality of walls including a second pair of walls having the same height as the first pair of walls, wherein the second pair of walls includes a plurality of feet for stacking at a first height on an identical tray at a first relative orientation and at a second height with the identical tray at a second relative orientation, 180 degrees from the first relative orientation; and a platform extending inwardly from an upper portion of each inner wall portion of each of the first pair of walls, wherein the platforms are cantilevered over the base from the inner surfaces of the inner wall portions and project inwardly toward one another such that the platforms are nearer to one another than any other points on the first pair of the plurality of walls and wherein the platforms do not extend a full length of the respective walls.

2. The tray of claim 1 wherein each wall of the first pair of walls includes a pair of handles formed therein and wherein each platform is centered between the handles on the respective one of the first pair of walls.

3. The tray of claim 1 wherein each platform is generally hollow and wherein an interior of the hollow platform is open toward an exterior of the respective one of the first pair of walls.

4. The tray of claim 1 wherein the platforms each include a central support surface spaced away from outer support surfaces, a central ridge projecting upwardly from an inner edge of the central support surface, outer ridges projecting upwardly from inner edges of the outer support surfaces.

5. The tray of claim 1 in combination with two small trays stacked directly on the tray, the two small trays supported partially on the platforms.

6. The tray of claim 1 wherein the platforms extend toward one another over the base and the space between the base and each platform is void of structure.

7. The tray of claim 1 wherein the second pair of walls include recesses for receiving feet of an identical tray thereon.

8. The tray of claim 1 wherein the first pair of walls are longer than the second pair of walls.

9. The tray of claim 1 wherein each platform is generally hollow and wherein an interior of each hollow platform has an opening through an outer surface of each outer wall portion.

10. A tray comprising:

a base wall;

a pair of opposed side walls extending upward from side edges of the base wall;

opposed front and rear walls extending upward from front and rear edges of the base wall, wherein the pair of side walls includes a plurality of feet for stacking at a first height on an identical tray at a first relative orientation and at a second height with the identical tray at a second relative orientation, 180 degrees from the first relative orientation; and a platform extending inwardly from inner-most surfaces of upper portions of each of the front wall and the rear wall, wherein the platforms extend toward one another over the base wall and are spaced above the base wall and wherein the platforms are centered on the front and rear walls and do not extend a full length of the front wall and rear wall.

11. The tray of claim 10 wherein the front wall and the rear wall each includes a pair of handles formed therein and wherein each platform is centered between the handles.

12. The tray of claim 10 wherein each platform includes a central support surface spaced away from outer support surfaces, a central ridge projecting upwardly from an inner edge of the central support surface, and outer ridges projecting upwardly from inner edges of the outer support surfaces.

13. The tray of claim 12 in combination with two smaller trays cross-stacked directly on the tray, the two smaller trays supported partially on the platforms.

14. The tray of claim 10 wherein each platform is generally hollow and wherein an interior of the hollow platform is open through an exterior surface of the respective front and rear walls.

15. The tray of claim 10 wherein the tray can stack at a first height with an identical tray at a first relative orientation and at a second height with the identical tray at a second relative orientation, 180 degrees from the first relative orientation.

16. The tray of claim 10 in combination with two smaller trays cross-stacked directly on the tray, the two smaller trays supported partially on the platforms.

17. A tray comprising:

a base including recessed portions;

a pair of side walls extending upward from the base, wherein the pair of side walls includes a plurality of feet for stacking at a first height on an identical tray at a first relative orientation and at a second height with the identical tray at a second relative orientation, 180 degrees from the first relative orientation;

a front wall and a rear wall extending upward from the base, wherein the side walls are substantially the same height as the front wall and rear wall; and a platform projecting inward from an inner surface of an upper portion of each of the front wall and the rear wall, wherein the platforms are cantilevered from the front wall and the rear wall over the base, wherein the platforms are configured to be received in the recessed portions of the base of a similar tray stacked thereon.

18. The tray of claim 17 wherein the front wall has an interior surface facing an interior of the tray and an opposite exterior surface, wherein the platform on the front wall is generally hollow with an opening through the exterior surface of the front wall.

19. The tray of claim 17 wherein the platforms do not extend a full length of the front wall and the rear wall.

20. The tray of claim 19 wherein the platforms are centered on the front wall and the rear wall.

21. The tray of claim 17 wherein the front and rear walls each include an uppermost edge having a raised central portion adjacent the platforms.

22. The tray of claim 21 wherein the base includes a recessed portion below each of the front and rear walls, the recessed portions centered on the front and rear walls.

23. A tray comprising:

a base;

a plurality of walls extending upward from the base, including a first pair of walls each having an inner wall portion extending upward from the base, an interior of the tray defined between inner surfaces of the inner wall portions, wherein each wall of the first pair of walls includes a pair of handles formed therein, the plurality of walls including a second pair of walls having the same height as the first pair of walls, wherein the second pair of walls includes a plurality of feet for stacking at a first height on an identical tray at a first relative orientation and at a second height with the identical tray at a second relative orientation, 180 degrees from the first relative orientation; and a platform extending inwardly from an upper portion of each inner wall portion of each of the first pair of walls, wherein each platform is centered between the handles in the respective one of the first pair of walls, wherein the platforms are cantilevered over the base from the inner surfaces of the inner wall portions and project inwardly toward one another such that the platforms are nearer to one another than any other points on the first pair of the plurality of walls and wherein the platforms do not extend a full length of the respective walls.

24. A tray comprising:

a base;

a plurality of walls extending upward from the base, including a first pair of walls each having an inner wall portion extending upward from the base, an interior of the tray defined between inner surfaces of the inner wall portions, the plurality of walls including a second pair of walls having the same height as the first pair of walls, wherein the second pair of walls includes a plurality of feet for stacking at a first height on an identical tray at a first relative orientation and at a second height with the identical tray at a second relative orientation, 180 degrees from the first relative orientation; and a platform extending inwardly from an upper portion of each inner wall portion of each of the first pair of walls, wherein the platforms are cantilevered over the base from the inner surfaces of the inner wall portions and project inwardly toward one another such that the platforms are nearer to one another than any other points on the first pair of the plurality of walls and wherein the platforms do not extend a full length of the respective walls, wherein the platforms each include a central support surface spaced away from outer support surfaces, a central ridge projecting upwardly from an inner edge of the central support surface, outer ridges projecting upwardly from inner edges of the outer support surfaces.

25. A tray comprising:

a base;

a pair of side walls extending upward from the base, wherein the pair of side walls includes a plurality of feet for stacking at a first height on an identical tray at a first relative orientation and at a second height with the identical tray at a second relative orientation, 180 degrees from the first relative orientation;

a front wall and a rear wall extending upward from the base, wherein the side walls are substantially the same height as the front wall and rear wall, wherein the front wall has an interior surface facing an interior of the tray and an opposite exterior surface; and a platform projecting inward from an inner surface of an upper portion of each of the front wall and the rear wall, wherein the platforms are cantilevered from the front wall and the rear wall over the base, wherein the platform on the front wall is generally hollow with an opening through the exterior surface of the front wall.

26. A tray comprising:

a base;

a pair of side walls extending upward from the base, wherein the pair of side walls includes a plurality of feet for stacking at a first height on an identical tray at a first relative orientation and at a second height with the identical tray at a second relative orientation, 180 degrees from the first relative orientation;

a front wall and a rear wall extending upward from the base, wherein the side walls are substantially the same height as the front wall and rear wall; and a platform projecting inward from an inner surface of an upper portion of each of the front wall and the rear wall, wherein the platforms are cantilevered from the front wall and the rear wall over the base, wherein the platforms do not extend a full length of the front wall and the rear wall and are centered on the front wall and the rear wall.

* * * * *